US010197336B2

(12) United States Patent
Iwasaki et al.

(10) Patent No.: US 10,197,336 B2
(45) Date of Patent: Feb. 5, 2019

(54) HEAT EXCHANGER

(71) Applicant: CALSONIC KANSEI CORPORATION, Saitama-shi, Saitama (JP)

(72) Inventors: Mitsuru Iwasaki, Saitama (JP); Junichiro Hara, Saitama (JP)

(73) Assignee: CALSONIC KANSEI CORPORATION, Saitama (JP)

( * ) Notice: Subject to any disclaimer, the term of this patent is extended or adjusted under 35 U.S.C. 154(b) by 591 days.

(21) Appl. No.: 14/892,734

(22) PCT Filed: May 15, 2014

(86) PCT No.: PCT/JP2014/062918
§ 371 (c)(1),
(2) Date: Nov. 20, 2015

(87) PCT Pub. No.: WO2014/188942
PCT Pub. Date: Nov. 27, 2014

(65) Prior Publication Data

US 2016/0097599 A1 Apr. 7, 2016

(30) Foreign Application Priority Data

May 23, 2013 (JP) ..... 2013-108789

(51) Int. Cl.

| | |
|---|---|
| ***F28D 7/00*** | (2006.01) |
| ***F28F 1/40*** | (2006.01) |
| ***F28F 13/12*** | (2006.01) |
| ***F28F 3/02*** | (2006.01) |
| ***F28D 7/16*** | (2006.01) |
| ***F28D 21/00*** | (2006.01) |
| *F02M 26/32* | (2016.01) |

(52) U.S. Cl.
CPC ..... *F28D 7/0066* (2013.01); *F28D 7/1684* (2013.01); *F28D 21/0003* (2013.01); *F28F 1/40* (2013.01); *F28F 3/027* (2013.01); *F28F 13/12* (2013.01); *F02M 26/32* (2016.02)

(58) Field of Classification Search
CPC .. F28D 7/0066; F28D 7/1684; F28D 21/0003; F28F 3/027; F28F 13/12; F28F 1/40; F02M 26/32
USPC ..... 165/158
See application file for complete search history.

(56) References Cited

U.S. PATENT DOCUMENTS 6,450,245 B1 * 9/2002 Chen ..... F28D 19/044 165/10
9,080,819 B2 * 7/2015 Nakano ..... F28F 1/126
(Continued)

FOREIGN PATENT DOCUMENTS

JP 2003-106794 A 4/2003
JP 2003-227691 A 8/2003
(Continued)

*Primary Examiner* — Claire Rojohn, III
(74) *Attorney, Agent, or Firm* — Foley & Lardner LLP

(57) ABSTRACT

A first projection plate and a second projection plate of each segment of first plurality of segments cause gas flowing into each segment to flow out from each segment while causing rotation in the gas in different directions with respect to a rotational axis in a gas flow direction and then flow into each of two segments of second plurality of segments adjacent in a perpendicular direction to the gas flow direction.

12 Claims, 27 Drawing Sheets

(56) References Cited

U.S. PATENT DOCUMENTS 10,048,020 B2 * 8/2018 Sperandei ..... F28F 1/128
2001/0035284 A1 * 11/2001 Iwasaki ..... F28D 1/0435 165/135
2002/0011331 A1 * 1/2002 Lehman ..... F25J 5/002 165/166
2002/0074105 A1 * 6/2002 Hayashi ..... B60H 1/025 165/43
2004/0173344 A1 * 9/2004 Averous ..... B01J 19/249 165/173
2005/0121181 A1 * 6/2005 Szulman ..... F25J 3/04412 165/166
2006/0016582 A1 * 1/2006 Hashimoto ..... F28D 7/1684 165/109.1
2006/0243429 A1 * 11/2006 Chu ..... F28D 1/0316 165/109.1
2006/0266507 A1 * 11/2006 Eom ..... D06F 58/24 165/166
2008/0142202 A1 * 6/2008 Hu ..... F28D 1/0391 165/151
2008/0190589 A1 * 8/2008 Kramer ..... F28F 1/128 165/152
2010/0095659 A1 * 4/2010 Kuroyanagi ..... F01N 5/02 60/320
2014/0238006 A1 * 8/2014 Iwasaki ..... F28F 3/027 60/320
2017/0107883 A1 * 4/2017 Kuroyanagi ..... F01N 5/02

FOREIGN PATENT DOCUMENTS

JP 2003-279293 A 10/2003
JP 2010-096456 A 4/2010
WO WO-2013/058267 A1 4/2013
WO WO-2013/080892 A1 6/2013

* cited by examiner

HEAT EXCHANGER

TECHNICAL FIELD

The present invention relates to a heat exchanger, and particularly to a heat exchanger in which a gas path through which gas flows and a liquid path through which liquid flows are stacked.

BACKGROUND ART

An exhaust heat exchange apparatus 100 as a relevant heat exchanger is disclosed in PTL1. As illustrated in FIG. 1, the exhaust heat exchange apparatus 100 includes an exterior case 101, multiple tubes 110 housed in the exterior case 101, and a pair of tanks 120, 121 arranged on both ends of the tubes 110.

The exterior case 101 is provided with a cooling water inlet portion 102 and a cooling water outlet portion 103 for cooling water which is cooling fluid. Cooling water paths 104 are formed by the spaces and the like between adjacent tubes 110 in the exterior case 101. Reference sign REF in the drawings indicates the flow direction of the cooling water.

Both ends of all the tubes 110 are open in the pair of tanks 120, 121. One tank 120 is provided with an exhaust inlet portion 120*a* and the other tank 121 is provided with an exhaust outlet portion 121*a*.

The multiple tubes 110 are stacked. As illustrated in FIG. 2, each tube 110 is formed of two flat members 110*a*, 110*b*. An exhaust path 111 is formed in the tube 110. A fin 112 is housed in the exhaust path 111 of each tube 110.

As illustrated in FIG. 3, the fin 112 is formed in a rectangular waveform. In the fin 112, multiple projection plates 113 are formed by cutting and raising at intervals in an exhaust gas flow direction S. The projection plates 113 project in a direction to block the exhaust flow in the exhaust path 111. The projection plates 113 each have a triangular shape. The projection plates 113 are arranged at a setting angle at which each projection plate 113 is inclined in a perpendicular direction to the exhaust gas flow direction S.

In the above-described configuration, exhaust gas discharged from an internal combustion engine flows through the exhaust path 111 in each tube 110. Cooling water flows through the cooling water paths 104 in the exterior case 101. The exhaust gas and the cooling water exchange heat via the tube 110 and the fin 112. When heat is exchanged, each projection plate 113 of the fin 112 disturbs the flow of the exhaust gas to promote heat exchange.

Next, promotive effect on heat exchange by the projection plates 113 will be specifically described. As illustrated in FIG. 4, when exhaust gas, which flows through the exhaust path 111, collides with the projection plate 113, the exhaust gas cannot flow straight, and thus a low-pressure region LPR is formed immediately downstream of the projection plate 113. As illustrated in FIGS. 5A, 5B, the exhaust gas collided with the projection plate 113 flows downstream as an overflow which goes around behind right and left lateral sides 113*a*, 113*b* of the projection plate 113. Since the projection plate 113 has a triangular shape, the overflow is divided into a first overflow from one lateral side 113*a* and a second overflow from the other lateral side 113*b* of the projection plate 113. Since the lateral sides 113*a*, 113*b* on both sides are inclined surfaces, the first overflow and the second overflow have a distribution such that the upper side of the inclination has a higher flow rate and the lower side of the inclination has a lower flow rate. A flow with such a distribution is drawn into the low-pressure region LPR, and thus a rotational force is applied to each of the first overflow and the second overflow which each form a spiral vortex flow as illustrated in FIG. 5C. In this manner, two spiral vortex flows are formed downstream of the projection plate 113. The two spiral vortex flows move while disturbing a boundary layer (exhaust gas stagnant layer) formed in the vicinity of the surface of the exhaust path 111, thereby increasing the heat exchange rate.

CITATION LIST

Patent Literature

Patent Literature 1: Japanese Unexamined Patent Application Publication No. 2010-96456

SUMMARY OF INVENTION

Incidentally, in the exhaust heat exchange apparatus 100, only one projection plate 113 is arranged in each single segment of the fin 112 and has a triangular shape, and thus the dam area for the exhaust gas flow is small and a low low-pressure region is seldom formed immediately downstream of the projection plate 113. Therefore, the drawing force of the first overflow and the second overflow into the low-pressure region LPR is weak, and thus small two branching spiral vortex flows are only formed. Even if one of the overflows is large and only one vortex flow is formed, since the drawing force is weak, only weak vortex flow is formed. As a consequence, it is not possible to significantly promote heat transfer by the vortex flow.

It is an object of the present invention to provide a heat exchanger capable of significantly promoting heat transfer with vortex flows due to projection plates of fins, and thereby improving the heat exchange rate.

A heat exchanger in accordance with some embodiments includes: a gas path for flowing gas; a first plurality of segments arranged in the gas path and arranged to respectively form projections and depressions repeated in a perpendicular direction to a gas flow direction; a second plurality of segments arranged in the gas path, arranged to respectively form projections and depressions repeated in the perpendicular direction to the gas flow direction, and located downstream of the first plurality of segments in the gas flow direction; a first projection plate arranged in the gas path and projecting from each segment of the first and second plurality of segments; and a second projection plate arranged in the gas path, projecting from each segment of the first and second plurality of segments, and located downstream of the first projection plate in the gas flow direction in each segment. An arrangement of the first plurality of segments and the second plurality of segments allows the gas to flow from two segments of the first plurality of segments adjacent in the perpendicular direction to the gas flow direction to a segment of the second plurality of segments. The first projection plate and the second projection plate of each segment of the first plurality of segments cause the gas flowing into each segment to flow out from each segment while causing rotation in the gas in different directions with respect to a rotational axis in the gas flow direction and then flow into each of two segments of the second plurality of segments adjacent in the perpendicular direction to the gas flow direction.

The first projection plates and the second projection plates may be a polygon with four or more sides.

The first projection plates and the second projection plates may be arranged in each segment at a forward tilt angle in a forward inclined state to an upstream side in the gas flow direction.

A first base side of each of the first projection plates in contact with each segment may be arranged obliquely at a first setting angle with respect to the perpendicular direction to the gas flow direction, and a second base side of each of the second projection plates in contact with each segment may be arranged at a second setting angle line-symmetrical to the first setting angle with respect to the perpendicular direction to the gas flow direction.

Out of a pair of first lateral sides standing from both ends of a first base side of each of the first projection plates in contact with each segment, one first lateral side of the pair of first lateral sides located downstream of the other first lateral side of the pair of first lateral sides in the gas flow direction may be longer than the other first lateral side, and out of a pair of second lateral sides standing from both ends of a second base side of each of the second projection plates in contact with each segment, one second lateral side of the pair of second lateral sides located downstream of the other second lateral side of the pair of second lateral sides in the gas flow direction may be longer than the other second lateral side.

A first top side farthest away from a first base side of each of the first projection plates in contact with each segment may be inclined with respect to the first base side such that one first lateral side of a pair of first lateral sides standing from both ends of the first base side and located downstream of the other first lateral side of the pair of first lateral sides in the gas flow direction is lower than the other first lateral side in a front view in the gas flow direction, and a second top side farthest away from a second base side of each of the second projection plates in contact with each segment may be inclined with respect to the second base side such that one second lateral side of a pair of second lateral sides standing from both ends of the second base side and located downstream of the other second lateral side of the pair of second lateral sides in the gas flow direction is lower than the other second lateral side in the front view in the gas flow direction.

An angle of the one first lateral side of each of the first projection plates with respect to the first base side may be smaller than 90 degrees, and an angle of the one second lateral side of each of the second projection plates with respect to the second base side may be smaller than 90 degrees.

An angle of the other first lateral side of each of the first projection plates with respect to the first base side may be larger than or equal to 90 degrees, and an angle of the other second lateral side of each of the second projection plates with respect to the second base side may be larger than or equal to 90 degrees.

The forward tilt angle may be 40 to 50 degrees with respect to the gas flow direction.

The first and second setting angles may be 33 to 65 degrees with respect to the perpendicular direction to the gas flow direction.

Corners between the pair of first lateral sides and the first top side of each of the first projection plates may have a curvature shape, and corners between the pair of second lateral sides and the second top side of each of the second projection plates may have a curvature shape.

A width of each of the first projection plates and a width of each of the second projection plates in the perpendicular direction to the gas flow direction may be 46% to 74% with respect to a width of each segment in the perpendicular direction to the gas flow direction.

A height of each of the first projection plates and a width of each of the second projection plates in the perpendicular direction to the gas flow direction may be 32% to 42% with respect to a height of each segment in the perpendicular direction to the gas flow direction.

A length between the pair of first lateral sides at the first base side of each of the first projection plates in the gas flow direction may be 13% to 26% with respect to a length of each segment in the gas flow direction, and a length between the pair of second lateral sides at the second base side of each of the second projection plates in the gas flow direction may be 13% to 26% with respect to a length of each segment in the gas flow direction.

A minimum interval between each of the first projection plates and each of the second projection plates may be 0% to 50% with respect to a length from an upstream end of each segment in the gas flow direction to the first base side of the one first lateral side of each of the first projection plates in the gas flow direction.

A length from one end of each segment in the gas flow direction to a lengthwise central point in the gas flow direction may be 35% to 67% with respect to a length of each segment in the gas flow direction, wherein the lengthwise central point is a central position in the gas flow direction between a first auxiliary line and a second auxiliary line, the first auxiliary line passes through a central position of the first base side of each of the first projection plates in contact with each segment and is along the perpendicular direction to the gas flow direction, and the second auxiliary line passes through a central position of the second base side of each of the second projection plates in contact with each segment and is along the perpendicular direction to the gas flow direction.

A length from one end of each segment in the perpendicular direction to the gas flow direction to a widthwise central point in the perpendicular direction to the gas flow direction may be 26% to 70% with respect to a width of each segment in the perpendicular direction to the gas flow direction, wherein the widthwise central point is a central position in the perpendicular direction to the gas flow direction between a third auxiliary line and a fourth auxiliary line, the third auxiliary line passes through a central position of the first base side of each of the first projection plates in contact with each segment and is along the gas flow direction, and the fourth auxiliary line passes through a central position of the second base side of each of the second projection plates in contact with each segment and is along the gas flow direction.

A height of each segment in the perpendicular direction to the gas flow direction may be 16% to 38% with respect to a length of each segment in the gas flow direction.

A width of each segment in the perpendicular direction to the gas flow direction may be 12% to 40% with respect to a length of each segment in the gas flow direction.

A width of each segment in the perpendicular direction to the gas flow direction may be 85% to 110% with respect to a height of each segment in the perpendicular direction to the gas flow direction.

An amount of displacement, in the perpendicular direction to the gas flow direction, of the segments adjacent in the gas flow direction may be 28% to 69% with respect to a width of the segment located upstream of the other segment of the segments adjacent in the gas flow direction.

The first projection plates of the segments adjacent in the perpendicular direction to the gas flow direction may project symmetrically to each other, the second projection plates of the segments adjacent in the perpendicular direction to the gas flow direction may project symmetrically to each other, setting angles at which base sides of the first projection plates of the segments adjacent in the perpendicular direction to the gas flow direction in contact with the segments are arranged obliquely with respect to the perpendicular direction to the gas flow direction may be the same, and setting angles at which base sides of the second projection plates of the segments adjacent in the perpendicular direction to the gas flow direction in contact with the segments are arranged obliquely with respect to the perpendicular direction to the gas flow direction may be the same.

Setting angles at which base sides of the first projection plates of the segments adjacent in the gas flow direction in contact with the segments are arranged obliquely with respect to the perpendicular direction to the gas flow direction may be line-symmetric with respect to the perpendicular direction to the gas flow direction, and setting angles at which base sides of the second projection plates of the segments adjacent in the gas flow direction in contact with the segments are arranged obliquely with respect to the perpendicular direction to the gas flow direction may be line-symmetric with respect to the perpendicular direction to the gas flow direction.

According to the aforementioned configuration, the gas flowed in a segment is made to flow out as a longitudinal vortex flow from the segment by the first projection plate and the second projection plate provided in the segment, the longitudinal vortex flow having a rotational axis in the gas flow direction. The longitudinal vortex flow does not attenuate early like a transverse vortex flow which has a rotational axis in the perpendicular direction to the gas flow direction, and thus continues to be present for a long time.

Such longitudinal vortex flows are generated to have different rotation by the first projection plate and the second projection plate. Thus, the longitudinal vortex flows work in a direction in which mutual rotation is strengthened in a boundary region between the longitudinal vortex flows with different rotations in the segment, thereby enabling promotion of mixing fluid in a boundary layer (exhaust gas stagnant layer) formed in the vicinity of the peripheral surface included in the exhaust path, and thus heat transfer can be significantly promoted.

Therefore, it is possible to provide a heat exchanger capable of significantly promoting heat transfer and improving the heat exchange rate by vortex flows due to projection plates of fins.

DESCRIPTION OF EMBODIMENTS

Figure 1:
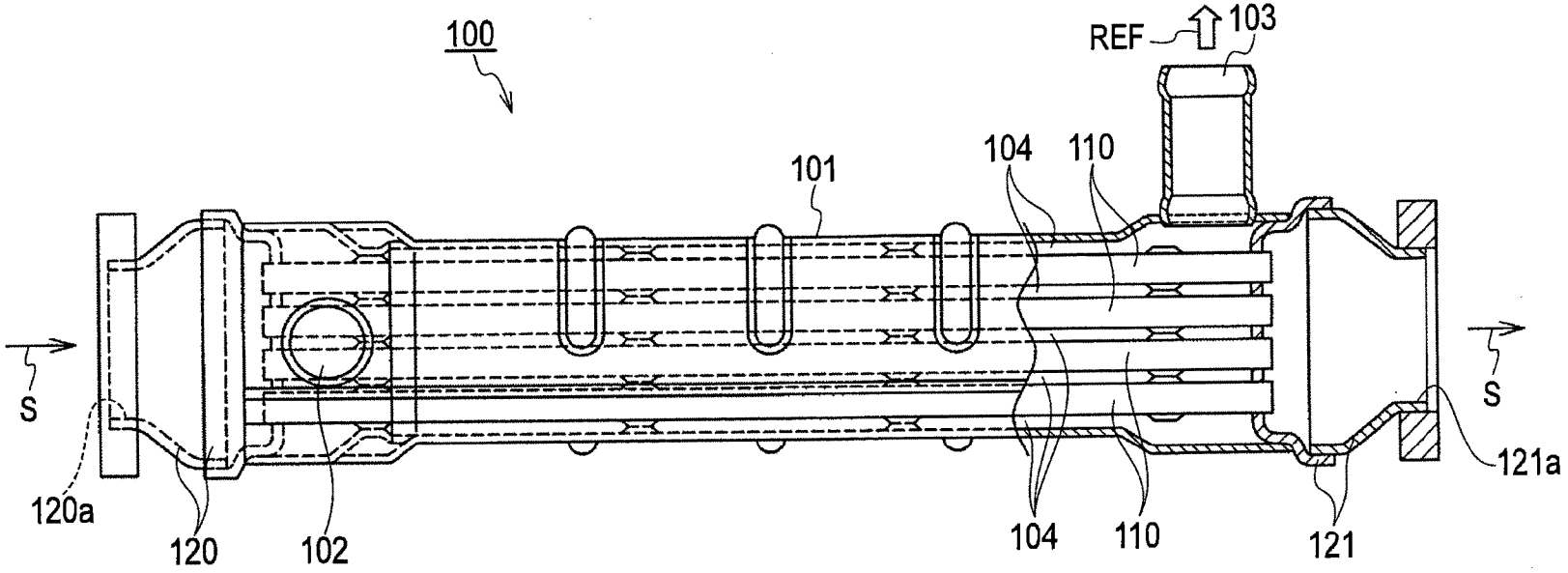
FIG. 1 is a partially cutaway view of a relevant exhaust heat exchange apparatus.
Figure 2:
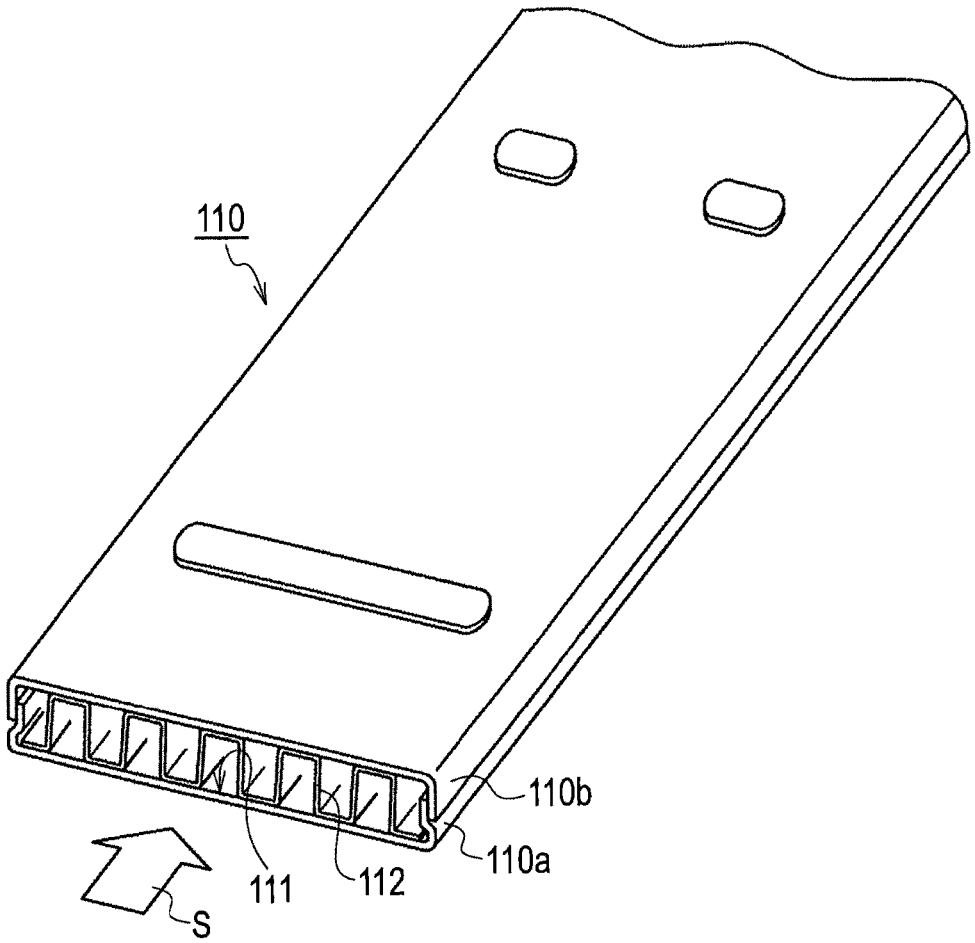
FIG. 2 is a perspective view of a relevant tube.
Figure 3:
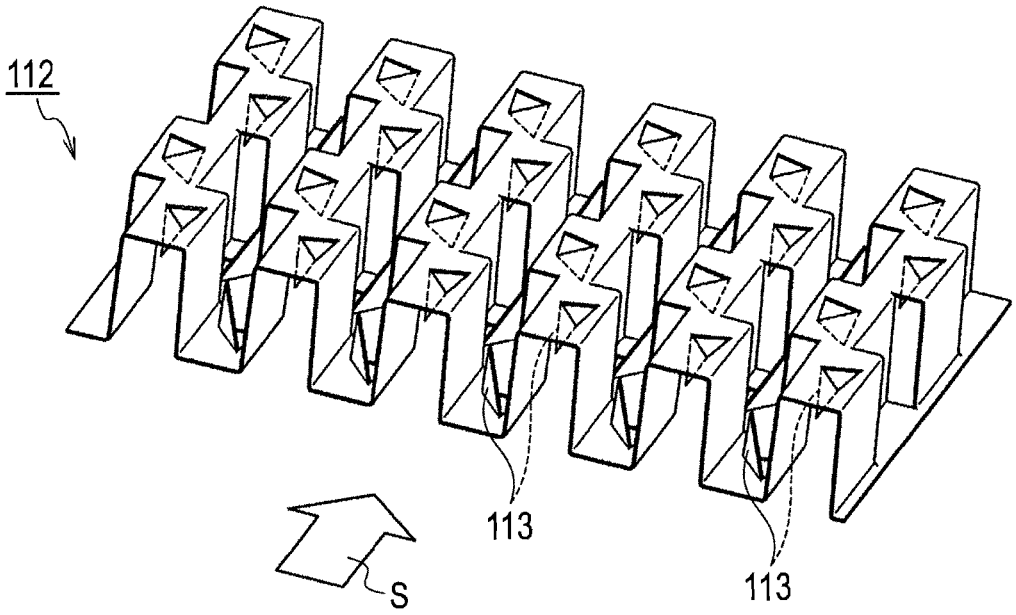
FIG. 3 is a perspective view of a relevant fin.
Figure 4:
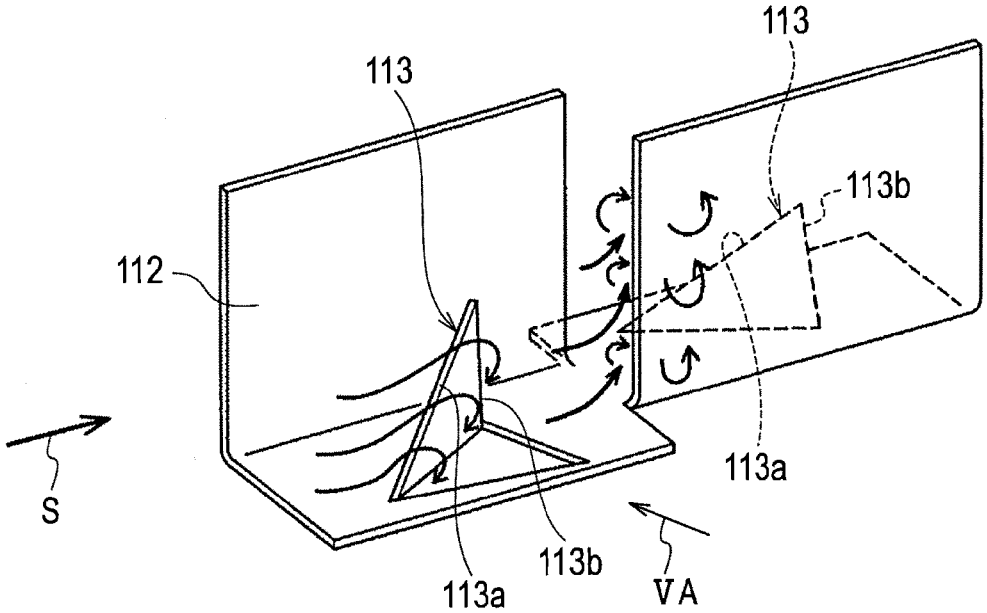
FIG. 4 is a perspective view of a relevant projection plate.
Figure 5A:
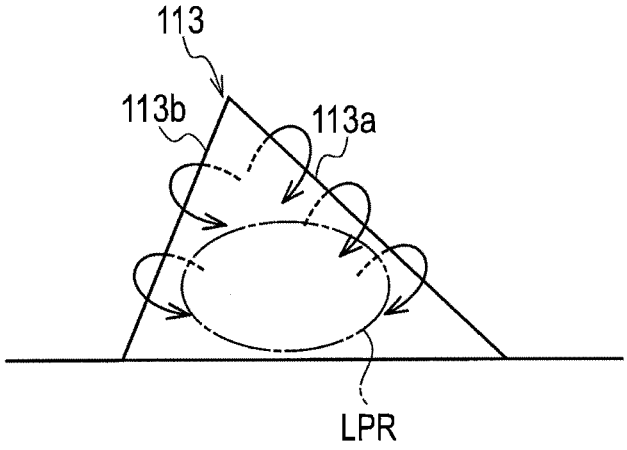
FIG. 5A is a view of the relevant projection plate as seen in direction of VA in FIG. 4.
Figure 5B:
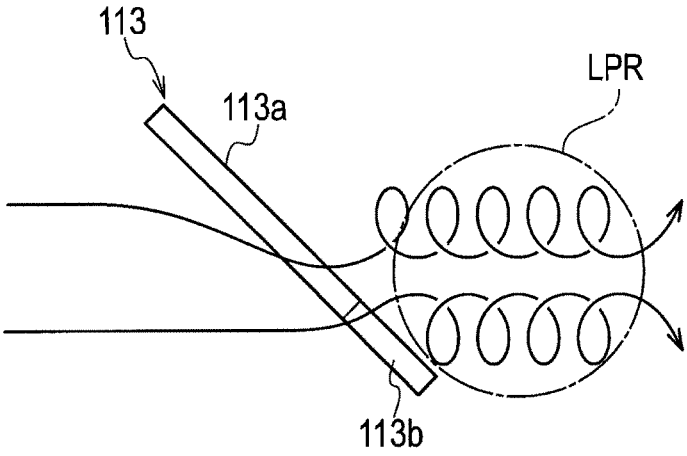
FIG. 5B is a plan view of the relevant projection plate.
Figure 5C:
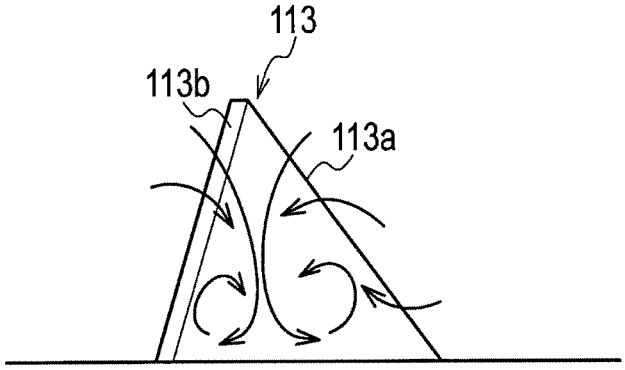
FIG. 5C is a view of a vortex flow formed downstream of the relevant projection plate, as seen from a downstream side of the projection plate.
Figure 6A:
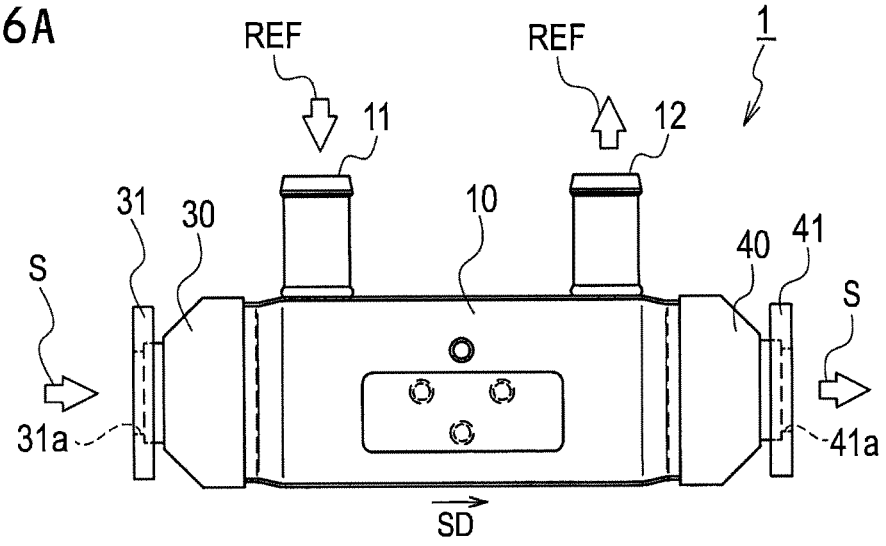
FIG. 6A is a side view of a heat exchanger according to an embodiment of the present invention.
Figure 6B:
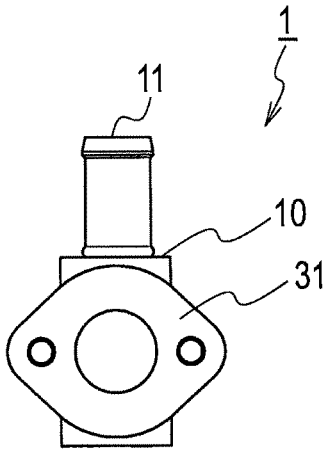
FIG. 6B is a front view of the heat exchanger according to the embodiment of the present invention.
Figure 6C:
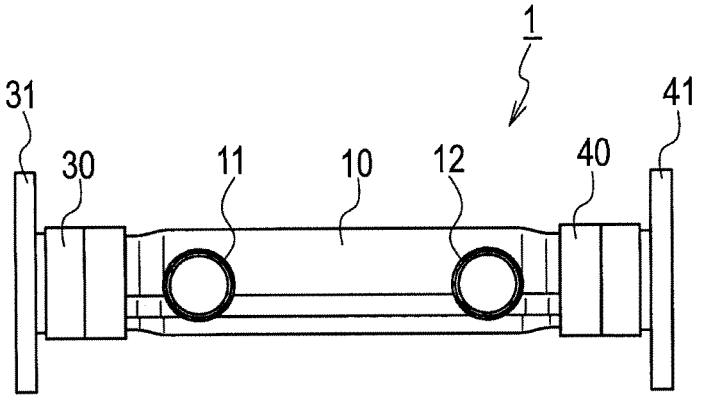
FIG. 6C is a plan view of the heat exchanger according to the embodiment of the present invention.

Next, an embodiment of a heat exchanger according to the present invention will be described with reference to the drawings. It is to be noted that in the following description of the drawings, the same or a similar part is denoted by the same or a similar reference sign. However, it should be noted that the drawings are schematic and the ratio and the like between the dimensions is different from actual ratio. Therefore, specific dimensions and the like should be estimated in consideration of the following description. Also, in between the drawings, some portions may have a different relationship or ratio between mutual dimensions.

(Configuration of Heat Exchanger)

First, the configuration of a heat exchanger 1 according to the present embodiment will be described with reference to the drawings. FIGS. 6A to 6C and FIGS. 7A, 7B are views illustrating the heat exchanger 1 according to the present embodiment. The heat exchanger 1 according to the present embodiment is to be an EGR cooler as an exhaust gas recirculation device. Also, reference sign REF in the figures indicates a flow direction of cooling water and reference sign S indicates a flow direction of exhaust gas.

As illustrated in FIGS. 6A to 6C and FIGS. 7A, 7B, the heat exchanger 1 includes an exterior case 10, multiple tubes 20 housed in the exterior case 10, and a pair of tanks 30, 40 arranged on both ends of the tubes 20. These components are composed of, for instance, a material superior in heat resistance, corrosion resistance (for instance, stainless steel material). Also, these members are fixed to contact points to each other by brazing.

The exterior case 10 is provided with a cooling water inlet portion 11 and a cooling water outlet portion 12 for cooling water which is cooling liquid. In the exterior case 10, cooling water paths 13 as a liquid path are formed by the spaces between adjacent tubes 20, and the spaces between the tubes 20 at both end positions and the inner surface of the exterior case 10.

Multiple pieces of the tube 20 are stacked, and thereby exhaust paths 20A as a gas path through which exhaust gas flows and the above-described cooling water paths 13 are alternately provided. It is to be noted that the details of the tube 20 will be described later.

In the pair of tanks 30, 40, both ends of all the tubes 20 are open. In one tank 30, an inlet header 31, in which an inlet 31*a* through which exhaust gas is introduced is formed, is attached, and in the other tank 40, an outlet header 41, in which an outlet 41*a* through which exhaust gas is discharged is formed, is attached.

(Configuration of Tube)

Next, the configuration of the aforementioned tube 20 will be described with reference to the drawings. FIGS. 8 to 10B are views of the tube 20 according to the present embodiment.

Figure 7A:
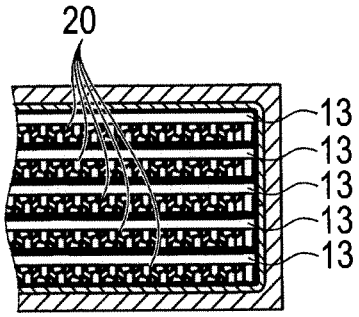
FIG. 7A is a transverse sectional view of part of the heat exchanger according to the embodiment of the present invention.
Figure 7B:
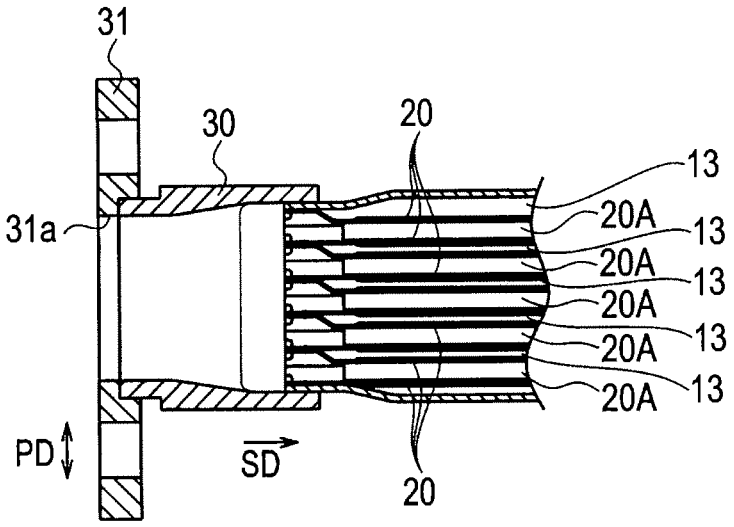
FIG. 7B is a longitudinal sectional view of part of the heat exchanger according to the embodiment of the present invention.

As illustrated in FIGS. 7A, 7B, the tube 20 is formed of two flat members (not illustrated). Bulged portions (not illustrated) are formed on both ends of the flat members in the longitudinal direction. The bulged portions come into contact with other tubes 20 with the tubes 20 stacked, thereby forming spaces that serve as the above-described cooling water paths 13 between the tubes 20.

Figure 8:
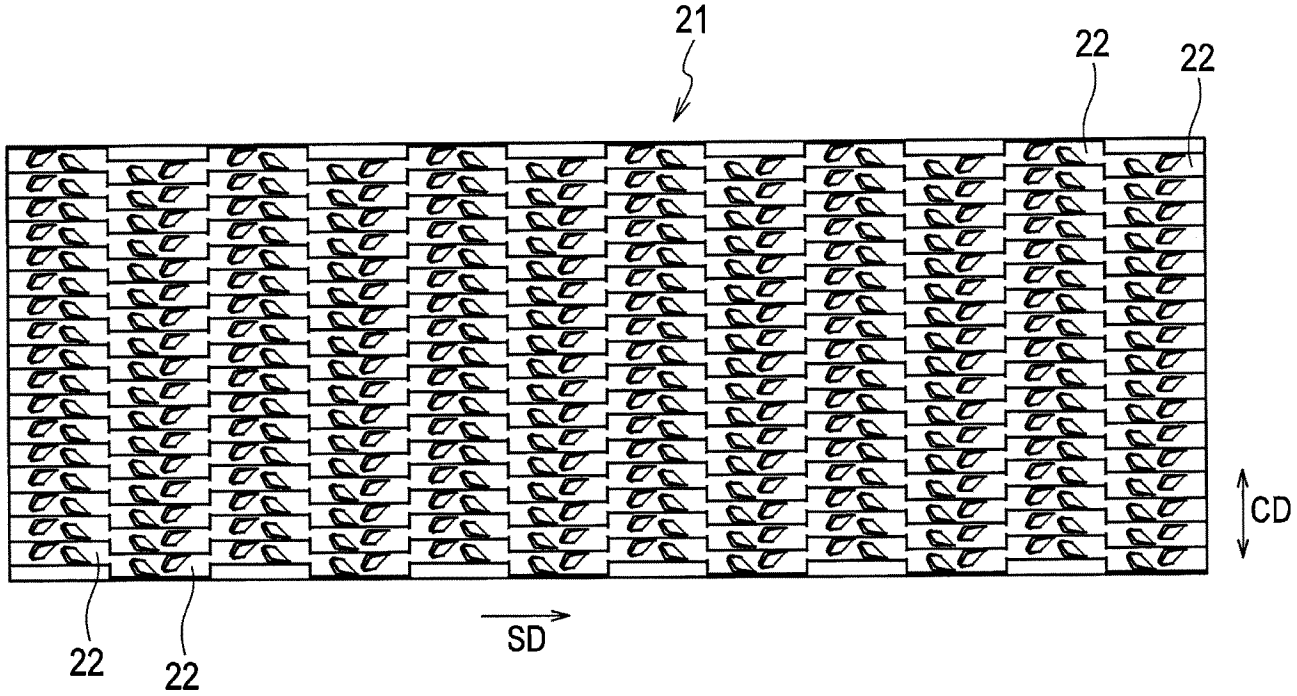
FIG. 8 is a plan view of a fin according to the embodiment of the present invention.
Figure 9:
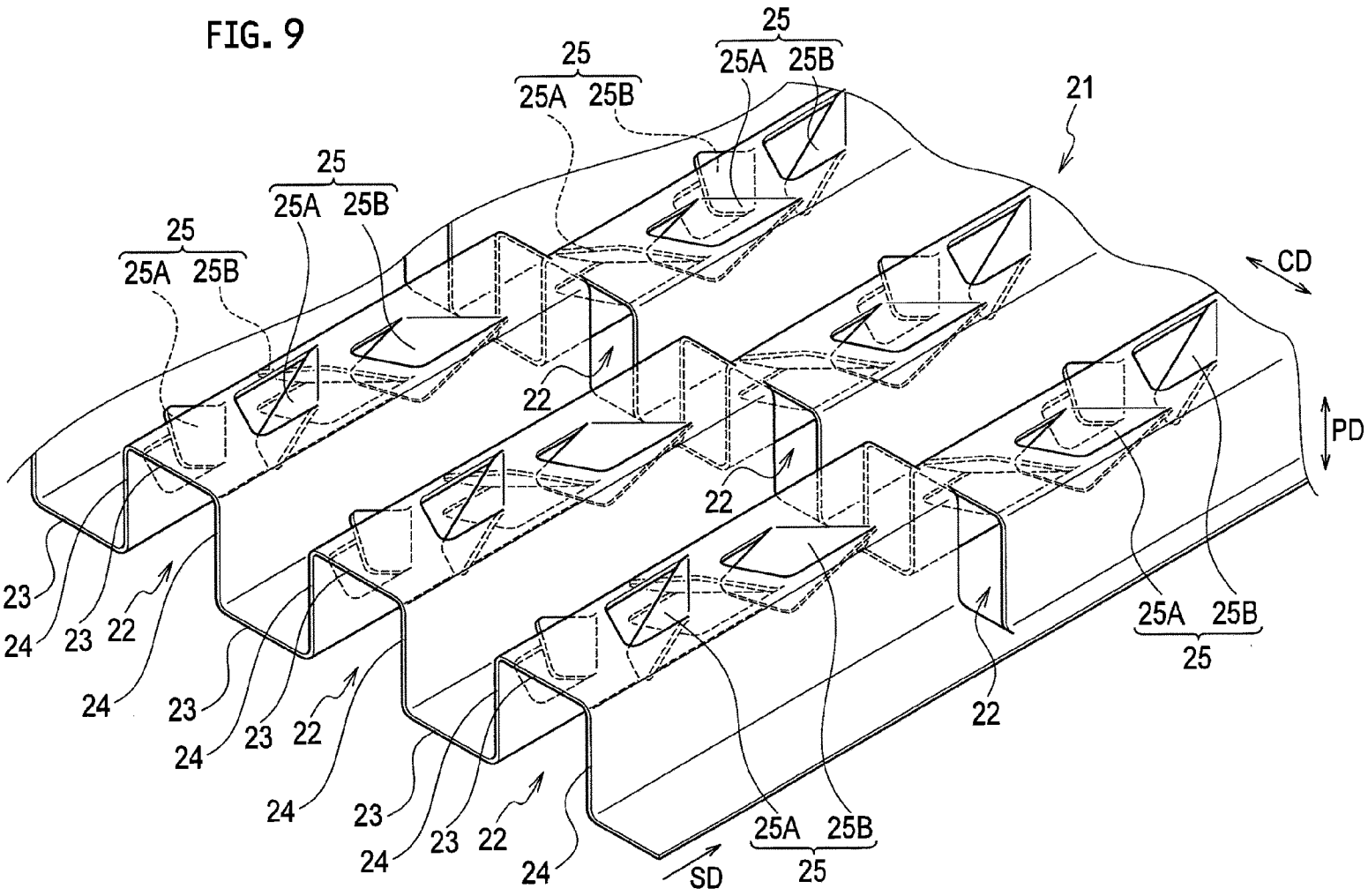
FIG. 9 is a perspective view of the fin according to the embodiment of the present invention.
Figure 10A:
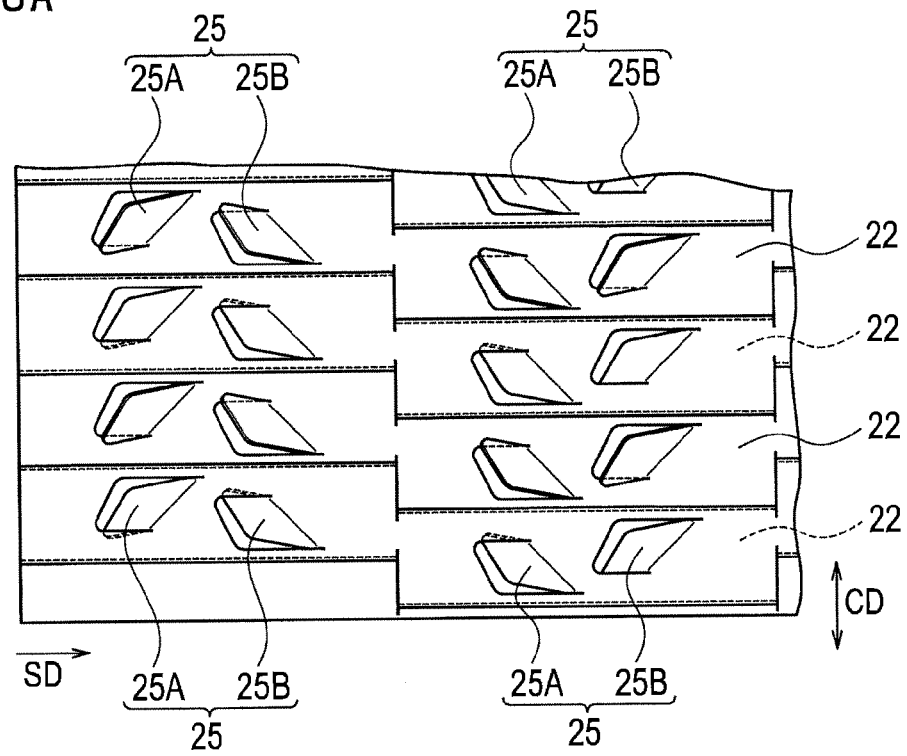
FIG. 10A is an enlarged plan view of the fin according to the embodiment of the present invention.
Figure 10B:
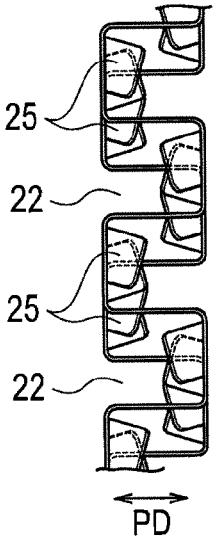
FIG. 10B is an enlarged front view of the fin according to the embodiment of the present invention.

As described above, the exhaust path 20A is formed in the tube 20. As illustrated in FIGS. 8 to 10B, the exhaust path 20A is divided into multiple segments 22 by a fin 21 as mentioned below. The fin 21 is housed in the exhaust path 20A of the tube 20. As illustrated in FIG. 9, the fin 21 is formed in a rectangular waveform shape in which a horizontal wall 23 which is a surface in close contact with the inner surface (that is, the cooling water path 13) of the tube 20, and a vertical wall 24 which divides the exhaust path 20A into multiple segments 22 are alternately arranged. In short, as illustrated in FIG. 8 and FIG. 9, each segment 22 repeats projections and depressions in a perpendicular direction CD to exhaust gas flow direction SD and to tube stacking direction PD, and is formed in an offset shape such that the segments 22 are alternately displaced by a predetermined length in the exhaust gas flow direction SD, and thereby multiple pieces of the segment 22 are arranged in the exhaust gas flow direction SD and in the perpendicular direction CD.

The segment 22 is formed by multiple inner surfaces (total of 4 surfaces combining 1 surface of the tube 20 and 3 surfaces of the fin 21) along the exhaust gas flow direction SD. In the horizontal wall 23 included in each segment 22, multiple projection plates 25 are formed by cutting and raising at spaced positions along the exhaust gas flow direction SD.

The projection plates 25 project in a direction to block the exhaust flow in the exhaust path 20A. Specifically, as illustrated in FIG. 16A, in one segment 22, the projection plate 25 has a first projection plate 25A which is arranged at a forward tilt angle (α1) in a forward inclined state to the upstream side in the exhaust gas flow direction SD, and a second projection plate 25B which is arranged downstream of the first projection plate 25A at a forward tilt angle (α2) in a forward inclined state to the upstream side in the exhaust gas flow direction SD.

(First Projection Plate)

Figure 11:
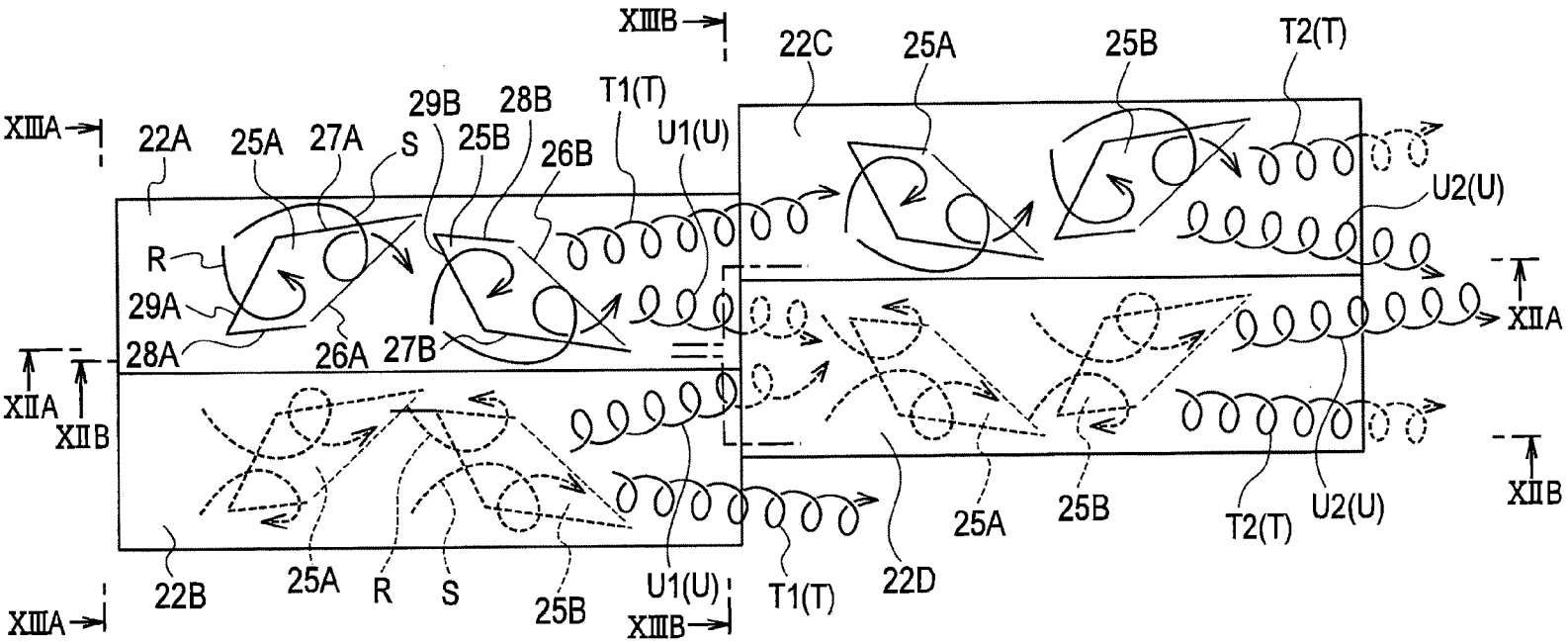
FIG. 11 is a schematic plan view of part of the fin according to the embodiment of the present invention.
Figure 12A:
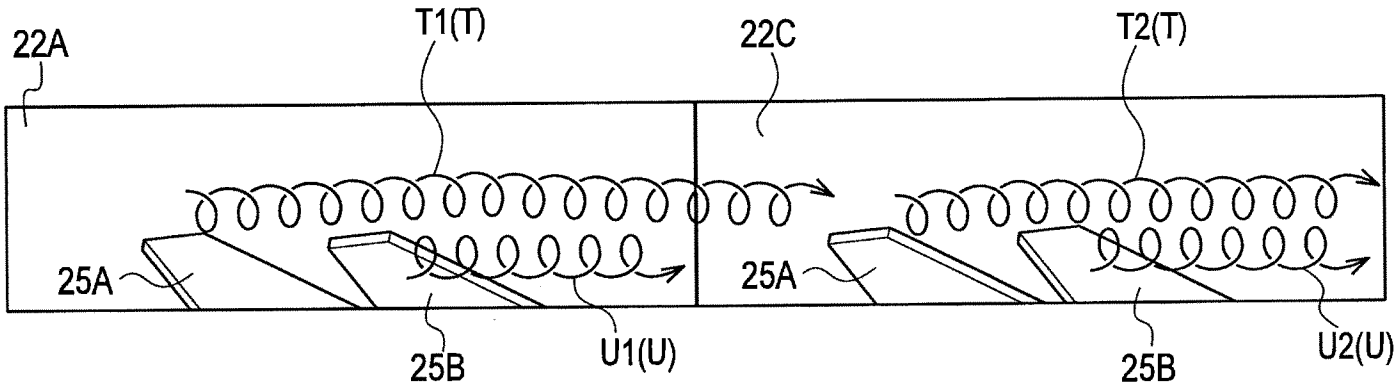
FIG. 12A is a sectional view taken along XIIA-XIIA of FIG. 11.
Figure 12B:
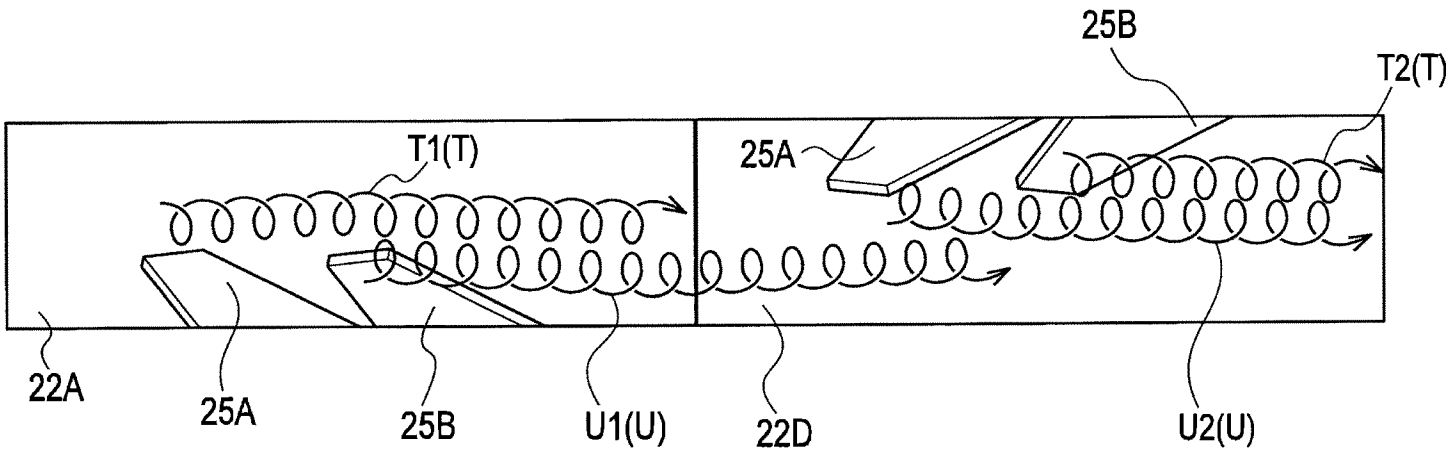
FIG. 12B is a sectional view taken along XIIB-XIIB of FIG. 11.
Figure 13A:
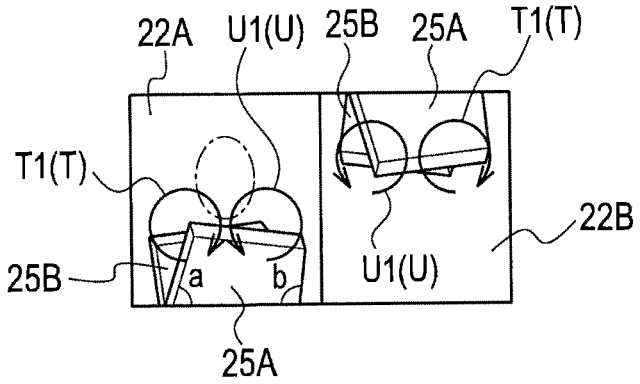
FIG. 13A is a sectional view taken along XIIIA-XIIIA of FIG. 11.
Figure 16A:
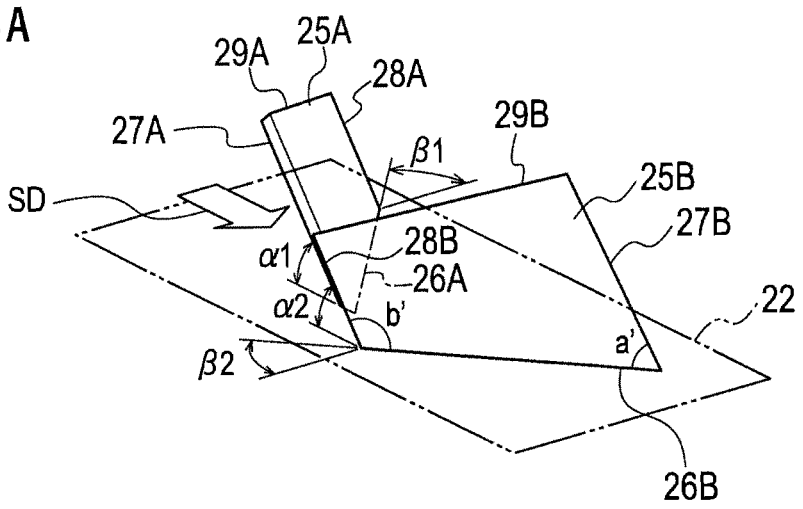
FIG. 16A is a perspective view illustrating a projection plate according to specification 1 of the embodiment of the present invention.

As illustrated in FIG. 11, FIG. 13A, FIG. 16A, the first projection plate 25A is formed by the trapezoid that consists of a base side 26A, a pair of right and left lateral sides 27A, 28A, and a top side 29A which is the farthest away from the base side 26A.

The base side 26A is arranged at a setting angle (β1) in an oblique direction with respect to the perpendicular direction CD. One lateral side 27A is located on a downstream side of the other lateral side 28A in the exhaust gas flow direction SD. The one lateral side 27A is longer than the other lateral side 28A. In other words, the other lateral side 28A is shorter than the one lateral side 27A.

An angle a of the one lateral side 27A with respect to the base side 26A is smaller than an angle b of the other lateral side 28A with respect to the base side 26A. Specifically, the angle a of the one lateral side 27A with respect to the base side 26A is set to be smaller than 90 degrees, and the angle b of the other lateral side 28A with respect to the base side 26A is set to be 90 degrees or more.

The top side 29A is set to be inclined with respect to the base side 26A so as to be higher on the other lateral side 28A side and not parallel to the base side 26A in a front view (see FIG. 11) in the tube stacking direction PD. In this manner, the top side 29A is made to be non-parallel to the base side 26A, and thus the top side 29A is inclined with respect to the base side 26A so as to be lower on the one lateral side 27A side and the top side 29A is approximately perpendicular to the exhaust gas flow direction SD in the front view (see FIG. 13A) in the exhaust gas flow direction SD.

As illustrated in FIGS. 8 to 10B, such first projection plates 25A are provided to project symmetrically in adjacent segments 22 in the perpendicular direction CD. Specifically, in one of the adjacent segments 22 in the perpendicular direction CD, the first projection plate 25A is arranged by cutting and raising from the horizontal wall 23 in contact with the cooling water path 13, and in the other of the adjacent segments 22 in the perpendicular direction CD, the first projection plate 25A is arranged by cutting and raising from the horizontal wall 23 in contact with the cooling water path 13 so that the top sides 29A face each other in the tube stacking direction PD. The first projection plates 25A arranged in the adjacent segments 22 in the perpendicular direction CD are set to have the same setting angle (β1) for the base sides 26A and the base sides 26A are arranged to be inclined in the same orientation with respect to the perpendicular direction CD.

On the other hand, the first projection plates 25A are arranged line-symmetrically with respect to the perpendicular direction CD in adjacent segments 22 in the exhaust gas flow direction SD. Specifically, the base side 26A of the first projection plate 25A arranged in one of the adjacent segments 22 in the exhaust gas flow direction SD, and the base side 26A of the first projection plate 25A arranged in the other of the adjacent segments 22 in the exhaust gas flow direction SD are arranged line-symmetrically with respect to the perpendicular direction CD. The first projection plates 25A, in which the base sides 26A are arranged line-symmetrically with respect to the perpendicular direction CD in adjacent segments 22 in the exhaust gas flow direction SD, are set to have the same setting angle (β1) for the base sides 26A.

(Second Projection Plate)

The second projection plate 25B is arranged line-symmetrically to the first projection plate 25A with respect to the perpendicular direction CD to the exhaust gas flow direction SD and to the tube stacking direction PD. In short, as illustrated in FIG. 11, FIG. 16A, the second projection plate 25B is formed by the trapezoid that consists of the base side 26B, a pair of right and left lateral sides 27B, 28B, and the top side 29B.

The base side 26B is arranged with the setting angle (β1) in an oblique direction with respect to the perpendicular direction CD. The base side 26B is provided line-symmetrically to the base side 26A of the above-described first projection plate 25A with respect to the perpendicular direction CD. One lateral side 27B is located on a downstream side of the other lateral side 28B in the exhaust gas flow direction SD. The one lateral side 27B is longer than the other lateral side 28B. In other words, the other lateral side 28B is shorter than the one lateral side 27B.

An angle a' of the one lateral side 27B with respect to the base side 26B is smaller than an angle b' of the other lateral side 28B with respect to the base side 26B. Specifically, the angle a' of the one lateral side 27B with respect to the base side 26B is set to be smaller than 90 degrees, and the angle b' of the other lateral side 28B with respect to the base side 26B is set to be 90 degrees or more.

The top side 29B is set to be inclined with respect to the base side 26B so as to be higher on the other lateral side 28B side and not parallel to the base side 26B in the front view (see FIG. 11) in the tube stacking direction PD. In this manner, the top side 29B is made to be non-parallel to the base side 26B, and thus the top side 29B is inclined with respect to the base side 26B so as to be lower on the one lateral side 27B side and the top side 29B is approximately perpendicular to the exhaust gas flow direction SD in the front view (see FIG. 13A) in the exhaust gas flow direction SD.

As illustrated in FIGS. 8 to 10B, such second projection plates 25B are provided to project symmetrically in adjacent segments 22 in the perpendicular direction CD. Specifically, in one of the adjacent segments 22 in the perpendicular direction CD, the second projection plate 25B is arranged by cutting and raising from the horizontal wall 23 in contact with the cooling water path 13, and in the other of the adjacent segments 22 in the perpendicular direction CD, the second projection plate 25B is arranged by cutting and raising from the horizontal wall 23 in contact with the cooling water path 13 so that the top sides 29B face each other in the tube stacking direction PD. The second projection plates 25B arranged in the adjacent segments 22 in the perpendicular direction CD are set to have the same setting angle (β1) for the base sides 26B and the base sides 26B are arranged to be inclined in the same orientation with respect to the perpendicular direction CD.

On the other hand, the second projection plates 25B are arranged line-symmetrically with respect to the perpendicular direction CD in adjacent segments 22 in the exhaust gas flow direction SD. Specifically, the base side 26B of the second projection plate 25B arranged in one of the adjacent segments 22 in the exhaust gas flow direction SD, and the base side 26B of the second projection plate 25B arranged in the other of the adjacent segments 22 in the exhaust gas flow direction SD are arranged line-symmetrically with respect to the perpendicular direction CD. The second projection plates 25B, in which the base sides 26B are arranged line-symmetrically with respect to the perpendicular direction CD in adjacent segments 22 in the exhaust gas flow direction SD, are set to have the same setting angle (β1) for the base sides 26B.

(Promotive Effect on Heat Exchange)

Next, the promotive effect on the heat exchange of the heat exchanger 1 according to the present embodiment will be described with reference to the drawings. FIGS. 11 to 13B are views illustrating the heat exchanger 1 according to the present embodiment. It is to be noted that in FIGS. 11 to 13B, the segment 22 is 4 segments of "segment 22A" to "segment 22D" as illustrated in FIG. 11.

Figure 14A:
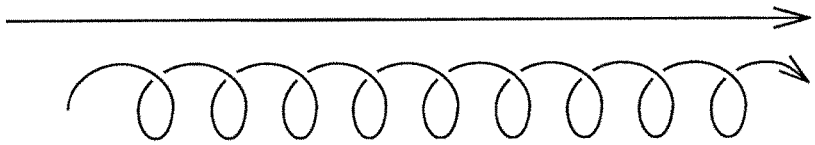
FIG. 14A is a schematic view of a transverse vortex flow according to the embodiment of the present invention.
Figure 14B:
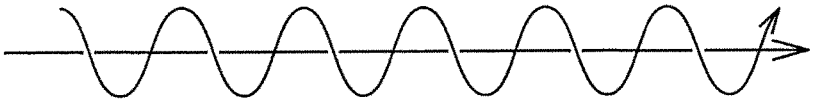
FIG. 14B is a schematic view of a longitudinal vortex flow according to the embodiment of the present invention.

Here, "transverse vortex flow" indicates a vortex flow that has a rotational axis in the perpendicular direction CD to the exhaust gas flow direction SD (and the tube stacking direction PD) and that moves in the exhaust gas flow direction SD as illustrated in FIG. 14A. On the other hand, "longitudinal vortex flow" indicates a vortex flow that has a rotational axis in the exhaust gas flow direction SD and that moves in the exhaust gas flow direction SD as illustrated in FIG. 14B.

Because a transverse vortex flow has a large shear velocity relative to the fluid surrounding the vortex flow, a pressure loss due to fluid friction increases, and thus the vortex flow attenuates early. On the other hand, a longitudinal vortex flow does not have a large shear velocity relative to the fluid surrounding the vortex flow, and thus the vortex flow continues to be present for a long time.

In this manner, a difference in lifespan occurs between a transverse vortex flow and a longitudinal vortex flow, and thus if a longitudinal vortex flow can be generated, mixture of fluid can be promoted for the wall surface (here, the wall surface of the segment 22) in the surrounding, and heat transfer can be promoted. Hereinafter, the promotive effect on the heat exchange of the heat exchanger 1 according to the present embodiment will be described.

First, in the heat exchanger 1 described above, exhaust gas discharged from an internal combustion engine flows through the exhaust path 20A in each tube 20. Cooling water flows through the cooling water path 13 in the exterior case 10. The exhaust gas and the cooling water exchange heat via the tube 20 and the fin 21. When heat is exchanged, the first projection plate 25A and the second projection plate 25B of the fin 21 disturb the flow of the exhaust gas to promote heat exchange.

Specifically, as illustrated in FIG. 11, in the segments 22A to 22D, when exhaust gas, which flows through the exhaust path 20A, collides with the first projection plate 25A, the exhaust gas cannot flow straight, and thus a low-pressure region is formed immediately downstream of the first projection plate 25A. In short, because the first projection plate 25A is a trapezoid (a quadrilateral or polygons with more than four sides), the dam area for gas flow of exhaust gas is large, and thus a sufficiently low low-pressure region is formed immediately downstream of the first projection plate 25A compared with the case where the first projection plate 25A is a triangle.

The first projection plate 25A is arranged in a forward inclined state to the downstream side in the exhaust gas flow direction SD, and thus the exhaust gas current, which moves on by rising above the top side 29A of the first projection plate 25A, cannot move on by smoothly changing its flow upward as in the case where the first projection plate 25A is arranged rearwardly inclined, and consequently, is likely to be drawn into the low-pressure region downstream of the first projection plate 25A. The drawing direction of the gas current, which moves on by rising above the top side 29A of the first projection plate 25A, is the direction toward the peripheral surface in contact with the base side 26A, and thus a strong transverse vortex flow R (see segment 22 of FIGS. 12A, 12B) is formed downstream of the first projection plate 25A by the gas current which moves on by rising above the top side 29A of the first projection plate 25A.

The transverse vortex flow R is generated more efficiently because the base side 26A and the top side 29A of the first projection plate 25A are not parallel, the one lateral side 27A longer than the other lateral side 28A is arranged on the downstream side in the exhaust gas flow direction SD, and so the top side 29A is arranged approximately perpendicular to the exhaust as flow direction SD.

On the other hand, similarly to the transverse vortex flow R, the gas current, which goes around behind the pair of lateral sides 27A, 28A of the first projection plate 25A and moves on, is drawn into the low-pressure region downstream of the first projection plate 25A. The low-pressure region downstream of the first projection plate 25A has a further lower pressure at the position of the one lateral side 27A than at the position of the other lateral side 28A, and thus the gas current is likely to be drawn in.

In addition, the one lateral side 27A is longer than the other lateral side 28A, and the angle a of the one lateral side 27A with respect to the base side 26A is set to be smaller than the angle b of the other lateral side 28A with respect to the base side 26A and less than 90 degrees (acute angle), and thus space can be formed that has a uniform interval between the inner wall of the segment 22 (here, the vertical wall 24) and the one lateral side 27A, and many gas currents S having a similar strength go around from the base side 26A side of the one lateral side 27A to the top side 29A side.

Therefore, the gas current S stronger than at the other lateral side 28A is drawn from the one lateral side 27A side to downstream of the first projection plate 25A and causes the transverse vortex flow R to turn. The drawing direction is different from the direction of the aforementioned gas current which rises above the top side 29A, and causes the turning direction of the aforementioned transverse vortex flow R to change.

As a consequence, the strong transverse vortex flow R formed by the gas current which moves on by rising above the top side 29A of the first projection plate 25A is converted to a strong longitudinal vortex flow T1 by the gas current S which goes around behind the one lateral side 28A. The longitudinal vortex flow T1 is a vortex flow that does not attenuate early like the transverse vortex flow R and continues to be present for a long time, and has clockwise rotation as illustrated in FIG. 13A.

On the other hand, in the segments 22A to D, due to the mechanism similar to that of the first projection plate 25A described above and by the second projection plate 25B arranged line-symmetrically with respect to the perpendicular direction CD, the strong transverse vortex flow R formed by the gas current which moves on by rising above the top side 29B of the second projection plate 25B is converted to a strong longitudinal vortex flow U1 by the gas current S which goes around behind the one lateral side 28B. As illustrated in FIG. 13A, the longitudinal vortex flow U1 has counterclockwise rotation which is the reverse rotation of the longitudinal vortex flow T1 generated by the first projection plate 25A.

The longitudinal vortex flow T1 and the longitudinal vortex flow U1 generated by the first projection plate 25A and the second projection plate 25B flow while disturbing a boundary layer (exhaust gas stagnant layer such as the inner surface of the tube 20 and the horizontal wall 23 of the fin 21) formed in the vicinity of the peripheral surface included in the exhaust path 20A, and thus heat transfer can be significantly promoted and the heat exchange rate can be improved.

In addition, the longitudinal vortex flow T1 and the longitudinal vortex flow U1 are reverse rotation, and thus have the same direction in the boundary region between the longitudinal vortex flow T1 and the longitudinal vortex flow U1 as illustrated in FIG. 13A (within a dashed dotted line indicated in the central portion of the exhaust path 20A in the width direction) and work in a direction in which mutual rotation is strengthened, and agitation is increased in the boundary layer formed in the vicinity of the peripheral surface included in the exhaust path 20A, and heat transfer can be further promoted significantly.

In this manner, the longitudinal vortex flow T1 and the longitudinal vortex flow U1 generated in one segment 22 by the first projection plate 25A and the second projection plate 25B each flow out to two segments 22 which are arranged with an offset on the downstream side in the exhaust gas flow direction SD.

Figure 13B:
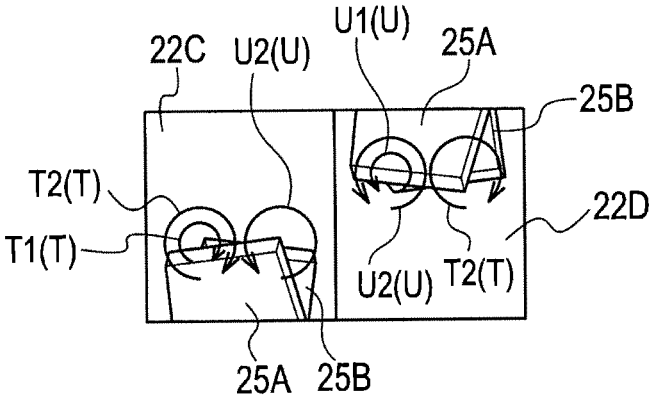
FIG. 13B is a sectional view taken along XIIIB-XIIIB of FIG. 11.

Specifically, as illustrated in FIG. 11, FIG. 13B, the longitudinal vortex flow T1 flowed out from the segment 22A flows into the segment 22C, and the longitudinal vortex flow U1 flowed out from the segment 22A flows into the segment 22D. At this point, the segment 22C and the segment 22D are arranged with an offset with respect to the segment 22A in the perpendicular direction CD, and thus the longitudinal vortex flow T1 and the longitudinal vortex flow U1 collide with the vertical wall 24 which is the partition between the segment 22C and the segment 22D, and the boundary layer in the vicinity of the vertical wall 24 can be agitated, and heat transfer can be further promoted significantly.

In the segment 22C in which the longitudinal vortex flow T1 flows, as illustrated in FIG. 11, FIG. 13B, two longitudinal vortex flow T2 and longitudinal vortex flow U2 having different rotation are generated by the above-described mechanism with the first projection plate 25A and the second projection plate 25B. Here, in the adjacent segment 22A and segment 22C in the exhaust gas flow direction SD, the first projection plates 25A are arranged line-symmetrically with respect to the perpendicular direction CD, and thus the longitudinal vortex flow T1 generated by the segment 22A flows into the longitudinal vortex flow T2 side in the same rotational direction. Therefore, as illustrated in FIG. 13B, the longitudinal vortex flow T1 induces generation of the longitudinal vortex flow T2, and a stronger longitudinal vortex flow T2 can be generated in the segment 22C due to the interaction between the longitudinal vortex flow T1 and the longitudinal vortex flow T2.

On the other hand, in the segment 22D into which the longitudinal vortex flow U1 flows, as illustrated in FIG. 11, FIG. 13B, two longitudinal vortex flow T2 and longitudinal vortex flow U2 having different rotation are generated by the above-described mechanism with the first projection plate 25A and the second projection plate 25B. Here, in the adjacent segment 22C and segment 22D in the perpendicular direction CD, the first projection plates 25A are arranged in the same direction with respect to the perpendicular direction CD, and thus the longitudinal vortex flow U1 generated by the segment 22A flows into the longitudinal vortex flow U2 side in the same rotational direction. Therefore, as illustrated in FIG. 13B, the longitudinal vortex flow U1 induces generation of the longitudinal vortex flow U2, and a stronger longitudinal vortex flow U2 can be generated in the segment 22D due to the interaction between the longitudinal vortex flow U1 and the longitudinal vortex flow U2.

In this manner, in the one segment 22, the longitudinal vortex flow T and the longitudinal vortex flow U having different rotation can be generated by the first projection plate 25A and the second projection plate 25B, mutual rotation is strengthened in the boundary region between the longitudinal vortex flow T and the longitudinal vortex flow U, and thus a long life of each vortex can be achieved. In addition, in the adjacent segments 22 in the exhaust gas flow direction SD, as the flow proceeds in a segment on the downstream side, the longitudinal vortex flow T and the longitudinal vortex flow U in the same rotational direction merge, and a further longer life of the vortex can be achieved due to the mutual interaction.

(Operation • Effect)

In the present embodiment described above, the gas, which flows into the segment 22, is made to flow out from the segment 22 as the longitudinal vortex flow T and the longitudinal vortex flow U having a rotational axis in the exhaust gas flow direction SD by the first projection plate 25A and the second projection plate 25B provided in the one segment 22. The longitudinal vortex flow T and the longitudinal vortex flow U do not attenuate early like a transverse vortex flow which has a rotational axis in the perpendicular direction CD to the exhaust gas flow direction SD, and thus continues to be present for a long time.

Such longitudinal vortex flow T and longitudinal vortex flow U are generated to have different rotation by the first projection plate 25A and the second projection plate 25B. Thus, in the segment 22, mutual rotation is strengthened in the boundary region between the longitudinal vortex flow T and longitudinal vortex flow U having different rotation, mixture of fluid can be promoted in the boundary layer (exhaust gas stagnant layer) formed in the vicinity of the peripheral surface included in the exhaust path 20A, and thus heat transfer can be significantly promoted.

Therefore, in the present embodiment, the longitudinal vortex flow T and the longitudinal vortex flow U having different rotation can be generated by the first projection plate 25A and the second projection plate 25B which are arranged in the segment 22, and thus heat transfer can be significantly promoted by the vortex flows caused by the projection plates 25 of the fin 21, and the heat exchange rate can be improved.

In the present embodiment, each of the segments 22 arranged in the exhaust gas flow direction SD and in the perpendicular direction CD is provided with the first projection plate 25A and the second projection plate 25B, and thus the longitudinal vortex flow T and the longitudinal vortex flow U collide with the vertical wall 24 of the segment 22 in addition to the boundary layer (exhaust gas stagnant layer) and the longitudinal vortex flow T and the longitudinal vortex flow U can significantly promote the heat transfer.

In the present embodiment, the first projection plate 25A and the second projection plate 25B are each a trapezoid and arranged in the segment 22 at a forward tilt angle ($\alpha$1, $\alpha$2) in a forward inclined state to the upstream side in the exhaust gas flow direction SD, the setting angles ($\beta$1, $\beta$2) for the base sides 26A, 26B, in an oblique direction with respect to the perpendicular direction CD are arranged line-symmetrically with respect to the perpendicular direction CD, the angles a, a' of the one lateral sides 27A, 27B with respect to the base sides 26A, 26B are smaller than the angles b, b' of the other lateral sides 28A, 28B with respect to the base sides 26A, 26B, and the top sides 29A, 29B are inclined with respect to the base sides 26A, 26B so as to be lower on the one lateral sides 27A, 27B side in the front view in the exhaust gas flow direction SD.

In this manner, the strong transverse vortex flow R formed by the gas current which moves on by rising above the top sides 29A, 29B of the first projection plate 25A and the second projection plate 25B can be converted to the strong longitudinal vortex flow T and longitudinal vortex flow U by the gas current S which goes around behind the one lateral sides 27A, 27B. Also, the setting angles ($\beta$1, $\beta$2) for the base sides 26A, 26B of the first projection plate 25A and the second projection plate 25B are arranged line-symmetrically with respect to the perpendicular direction CD, and thus the rotational directions of the longitudinal vortex flow T and the longitudinal vortex flow U can be made different.

In the present embodiment, since the one lateral sides 27A, 27B of the first projection plate 25A and the second projection plate 25B are longer than the other lateral sides 28A, 28B, the stronger gas current S can be generated, and thus the transverse vortex flow R generated from the top sides 29A, 29B can be converted to the longitudinal vortex flow T and the longitudinal vortex flow U more efficiently.

In the present embodiment, the top sides 29A, 29B of the first projection plate 25A and the second projection plate 25B are inclined with respect to the base sides 26A, 26B, the top sides 29A, 29B are not parallel to the base sides 26A, 26B, and thus the top sides 29A, 29B can be set in the direction perpendicular to the exhaust gas flow direction SD and stronger transverse vortex flow R can be generated.

In the present embodiment, since the one lateral sides 27A, 27B of the first projection plate 25A and the second projection plate 25B are located downstream of the other lateral sides 28A, 28B and the angles a, a' of the one lateral sides 27A, 27B with respect to the base sides 26A, 26B are set to be acute angles, the interval between the wall surface of the exhaust path 20A and the one lateral sides 27A, 27B is approximately constant and the gas current S generated from the one lateral sides 27A, 27B can be strengthened more.

In the present embodiment, in the adjacent segments 22 in the perpendicular direction CD, the first projection plate 25A and the second projection plate 25B are provided to project upward and downward symmetrically from the horizontal wall 23 of the segment 22, and thus the heat transfer from the upper and lower surfaces of the segments 22 stacked in the tube stacking direction PD can equalized in the exhaust gas flow direction SD by the longitudinal vortex flow T and the longitudinal vortex flow U which are generated by the first projection plate 25A and the second projection plate 25B.

In the present embodiment, in adjacent segments 22 in the exhaust gas flow direction SD, the setting angles ($\beta$1, $\beta$2) for the base sides 26A, 26B of the first projection plate 25A and the second projection plate 25B are arranged line-symmetrically with respect to the perpendicular direction CD, and thus heat transfer of the vertical wall 24, which is the partition between the adjacent segments 22 in the perpendicular direction CD, can be performed more efficiently.

(Comparative Evaluation)

Figure 15:
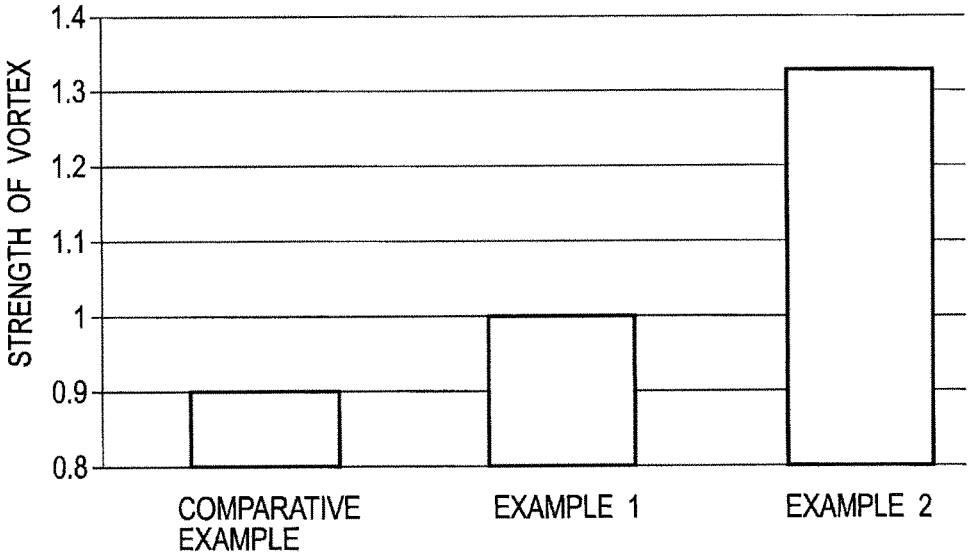
FIG. 15 is a diagram illustrating the strength of a vortex of a projection plate according to a comparative example and Examples 1, 2 of the present invention.

Next, comparative evaluation of the strength of a vortex of the above-described projection plate 25 (the first projection plate 25A and the second projection plate 25B) will be described with reference to the drawings. FIG. 15 is a diagram illustrating the strength of a vortex of the projection plate 25 according to the comparative example and Example 1, 2. It is to be noted that the strength of a vortex is calculated by the following expression.

$$\text{vortex strength } I_v = \int I_A dx' (x' = x/h) \quad \text{[Math 1]}$$

x is a coordinate in the flow direction when the setting position of the projection plate (vortex generation portion) is set as the origin. h is the setting height of the projection plate (vortex generation portion). $I_A$ is the magnitude of the second invariant Q per unit area of velocity gradient in a section of a flow path when the value of Q is positive.

Here, the projection plate according to the comparative example is formed by a trapezoid with the same angle of the right and left lateral sides. The projection plate 25 according to Example 1 is formed by a trapezoid in which the one lateral sides 27A, 27B have 60 degrees, the other lateral sides 28A, 28B have 90 degrees, and the top sides 29A, 29B are parallel to the base sides 26A, 26B. The projection plate 25 according to Example 2 is what has been described in the aforementioned embodiment.

The strength of a vortex generated by the projection plate 25 according to Example 1 is assumed to be "1 (reference value)", and the strength of a vortex generated by each of other projection plates was measured. As a result, as illustrated in FIG. 15, it has been demonstrated that in contrast to the strength of a vortex generated by the projection plate according to the comparative example, the strength of a vortex generated by the projection plate 25 according to Examples 1, 2 is stronger due to the above-described mechanism of vortex generation.

(Specification of Projection Plate and Small Path)

Next, various specifications of the aforementioned projection plate 25 and segment 22 will be described with reference to the drawings. It is to be noted that in the following, evaluation is performed by using the strength of a vortex generated by the projection plate 25 according to Example 1 described above as a reference value of "1". Also, the "optimal range" indicated in the figures refers to a state in which the strength of vortex is 1.25 to 1.30 or higher.

(Specification 1)

First, specification 1 of the projection plate 25 will be described with reference to FIGS. 16A, 16B. FIG. 16A is a perspective view illustrating the projection plate 25, and FIG. 16B is a characteristic diagram illustrating the strength of vortex with a varied forward tilt angles ($\alpha$1, $\alpha$2) of the first projection plate 25A and the second projection plate 25B.

The specification 1 is such that the setting angles ($\beta$1, $\beta$2) are 45 degrees, the angles a, a' of the one lateral sides 27A, 27B with respect to the base sides 26A, 26B are 45 degrees, the angles b, b' of the other lateral sides 28A, 28B with respect to the base sides 26A, 26B are 135 degrees, and the forward tilt angles (α1, α2) of the first projection plate 25A and the second projection plate 25B are varied.

Figure 16B:
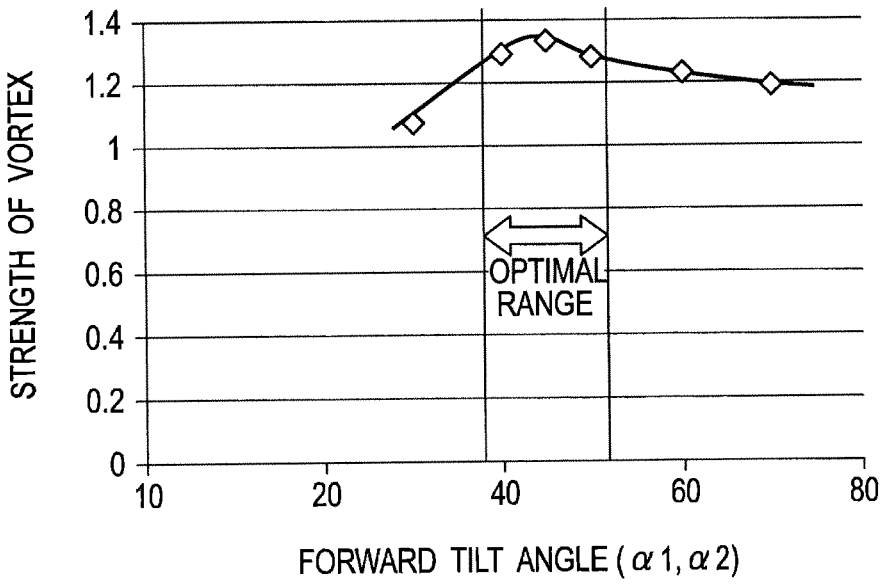
FIG. 16B is a characteristic diagram illustrating the strength of a vortex with a varied forward tilt angle of the projection plate according to specification 1 of the embodiment of the present invention.

As illustrated in FIG. 16A and FIG. 16B, it can be seen that the forward tilt angles (α1, α2) of the first projection plate 25A and the second projection plate 25B are 30 to 90 degrees with respect to the exhaust gas flow direction SD, and the strength of vortex flow is thereby greater than in Example 1 described above (that is, the strength of vortex is "1.00").

In particular, it is preferable that the forward tilt angles (α1, α2) of the first projection plate 25A and the second projection plate 25B be 40 to 50 degrees with respect to the exhaust gas flow direction SD. Thus, it can be seen that the strength of vortex is greater than or equal to "1.25" in contrast to Example 1 described above (that is, the strength of vortex is "1.00").

(Specification 2)

Figure 17A:
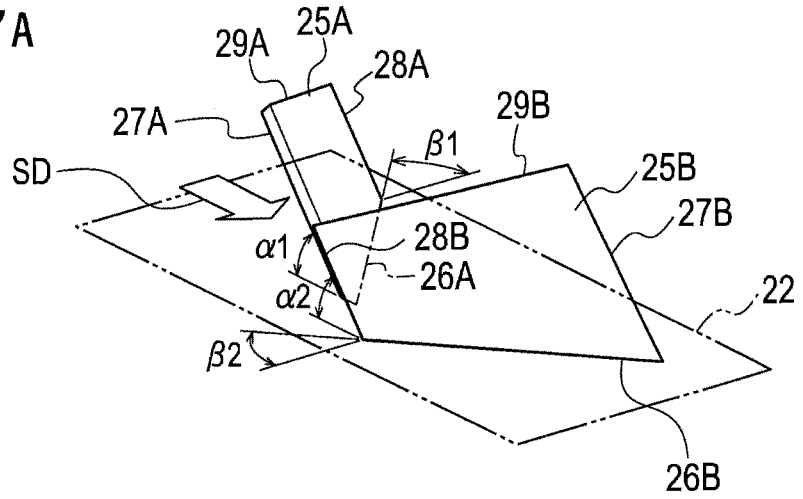
FIG. 17A is a perspective view illustrating a projection plate according to specification 2 of the embodiment of the present invention.

Next, specification 2 of the projection plate 25 will be described with reference to FIGS. 17A, 17B. FIG. 17A is a perspective view illustrating the projection plate 25, and FIG. 17A is a characteristic diagram illustrating the strength of vortex with a varied setting angles (β1, β2) of the first projection plate 25A and the second projection plate 25B.

The specification 2 is such that the forward tilt angles (α1, α2) are 45 degrees, the angles a, a' of the one lateral sides 27A, 27B with respect to the base sides 26A, 26B are 45 degrees, the angles b, b' of the other lateral sides 28A, 28B with respect to the base sides 26A, 26B are 135 degrees, and the setting angles (β1, β2) of the first projection plate 25A and the second projection plate 25B are varied.

Figure 17B:
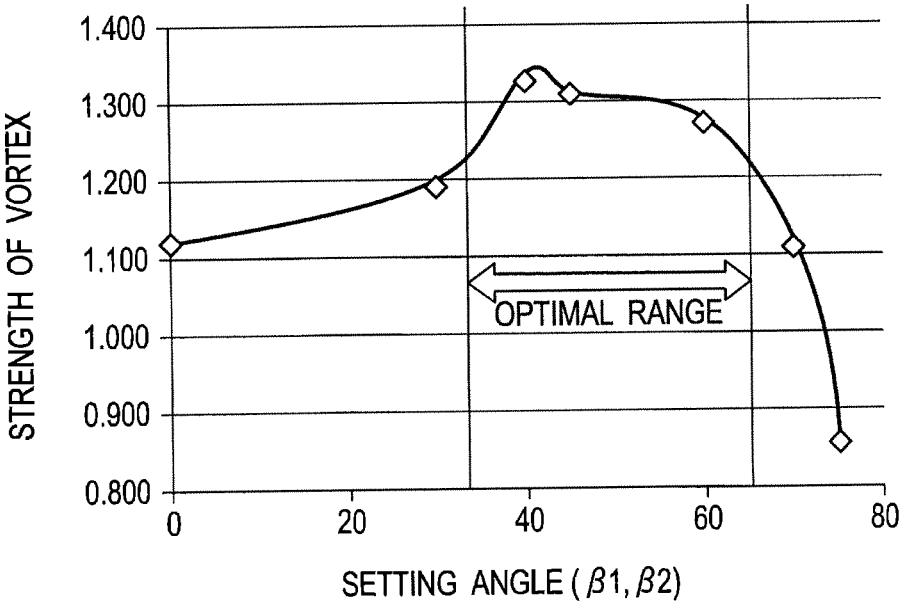
FIG. 17B is a characteristic diagram illustrating the strength of a vortex with a varied setting angle of the projection plate according to specification 2 of the embodiment of the present invention.

As illustrated in FIG. 17A and FIG. 17B, it can be seen that the setting angles (β1, β2) of the first projection plate 25A and the second projection plate 25B are 10 to 70 degrees with respect to the exhaust gas flow direction SD, and the strength of vortex flow is thereby stronger ("1.1" or higher) than in Example 1 described above (that is, the strength of vortex is "1.00").

In particular, it is preferable that the setting angles (β1, β2) of the first projection plate 25A and the second projection plate 25B be 33 to 65 degrees with respect to the exhaust gas flow direction SD. Thus, it can be seen that the strength of vortex is greater than or equal to "1.25" in contrast to Example 1 described above (that is, the strength of vortex is "1.00").

(Specification 3)

Figure 18A:
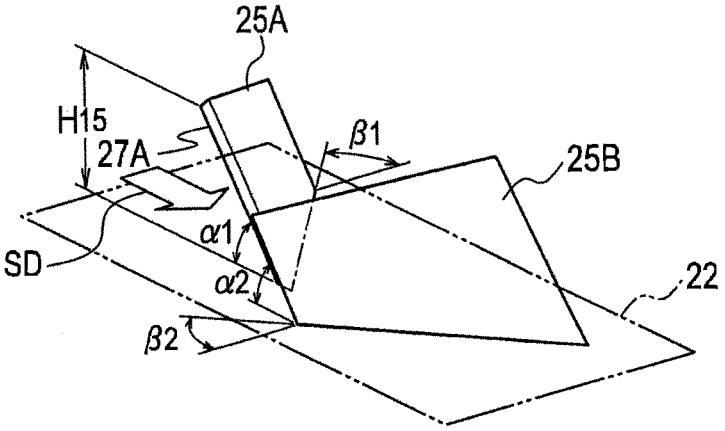
FIG. 18A is a perspective view illustrating a projection plate according to specification 3 of the embodiment of the present invention.

Next, specification 3 of the projection plate 25 will be described with reference to FIGS. 18A to 18C. FIG. 18A is a perspective view illustrating the projection plate 25, FIG. 18B is a front view illustrating the first projection plate 25A, and FIG. 18C is a characteristic diagram illustrating the strength of vortex with varied corners R1, R2 between the one lateral sides 27A, 27B and the top sides 29A, 29B of the first projection plate 25A and the second projection plate 25B.

The specification 3 is such that the forward tilt angles (α1, α2) are 45 degrees, the setting angles (β1, β2) are 45 degrees, the angles a, a' of the one lateral sides 27A, 27B with respect to the base sides 26A, 26B are 45 degrees, the angle b b' of the other lateral sides 28A, 28B with respect to the base sides 26A, 26B is 135 degrees, and for height H15 from the bottom wall surface of the segment 22 to the highest vertex of the top sides 29A, 29B of the first projection plate 25A and the second projection plate 25B, the corners R1, R2 are varied between the top side 29A and the one lateral sides 27A, 27B and the other lateral sides 28A, 28B of the first projection plate 25A and the second projection plate 25B.

Figure 18B:
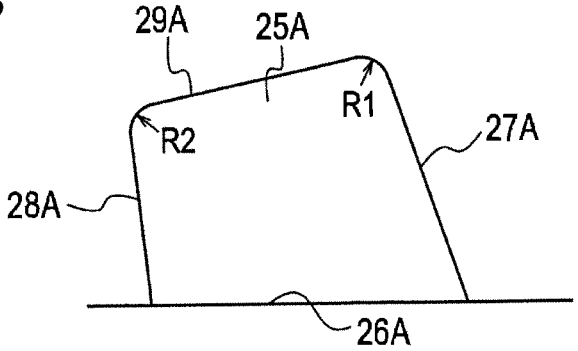
FIG. 18B is a front view illustrating the projection plate according to specification 3 of the embodiment of the present invention.
Figure 18C:
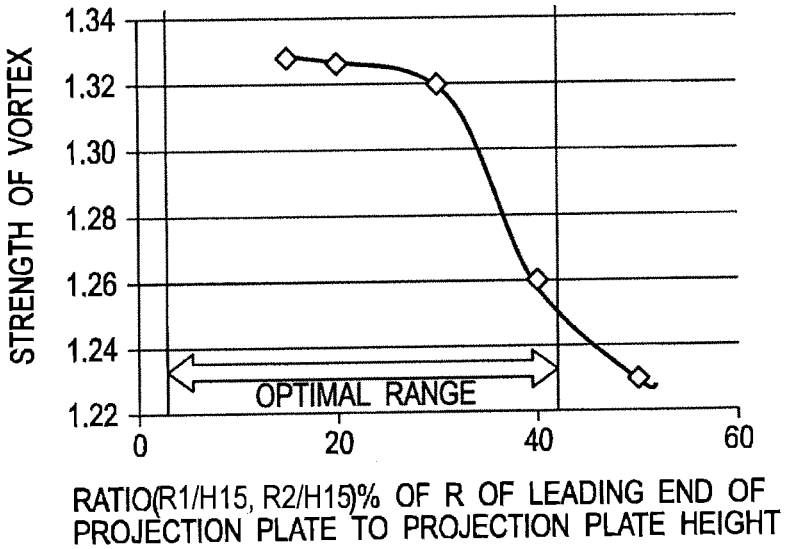
FIG. 18C is a characteristic diagram illustrating the strength of a vortex with varied corners between a pair of lateral sides and a top side of the projection plate according to specification 3 of the embodiment of the present invention.

As illustrated in FIG. 18B and FIG. 18C, for extension of lifespan of a blade, R-shape is formed on the corners R1, R2 between the top sides 29A, 29B and the one lateral sides 27A, 27B and the other lateral sides 28A, 28B of the first projection plate 25A and the second projection plate 25B. It is preferable that the corners R1, R2 have 5% to 42% of curvature shape (R-shape) with respect to height H15 from the base sides 26A, 26B to the highest vertex of the top sides 29A, 29B of the first projection plate 25A and the second projection plate 25B. Thus, it can be seen that the strength of vortex is greater than or equal to 1.25 in contrast to Example 1 described above (that is, the strength of vortex is "1.00").

(Specification 4)

Figure 19A:
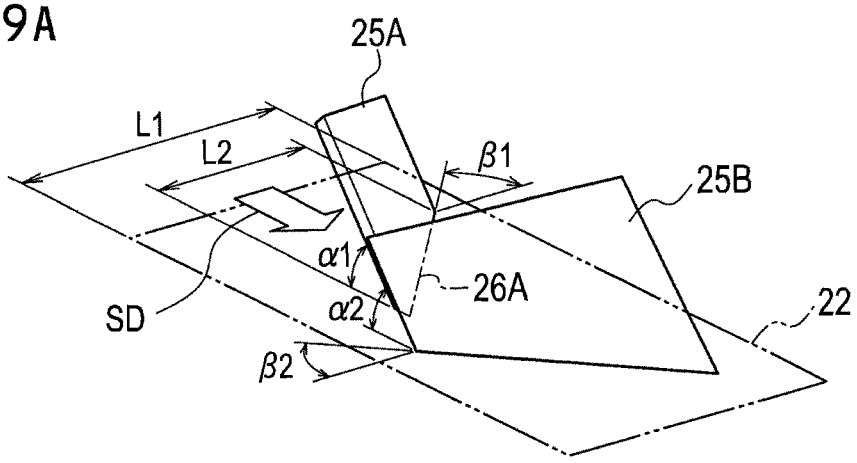
FIG. 19A is a perspective view illustrating a projection plate according to specification 4 of the embodiment of the present invention.

Next, specification 4 of the projection plate 25 will be described with reference to FIGS. 19A, 19B. FIG. 19A is a perspective view illustrating the projection plate 25, and FIG. 19B is a characteristic diagram illustrating the strength of vortex with varied width L2 of the first projection plate 25A and the second projection plate 25B for width L1 of the segment 22.

The specification 4 is such that the width L2 of the first projection plate 25A and the second projection plate 25B along the perpendicular direction CD to the exhaust gas flow direction SD is varied. It is to be noted that other conditions of the first projection plate 25A and the second projection plate 25B are the same as the specification 3 described above.

Figure 19B:
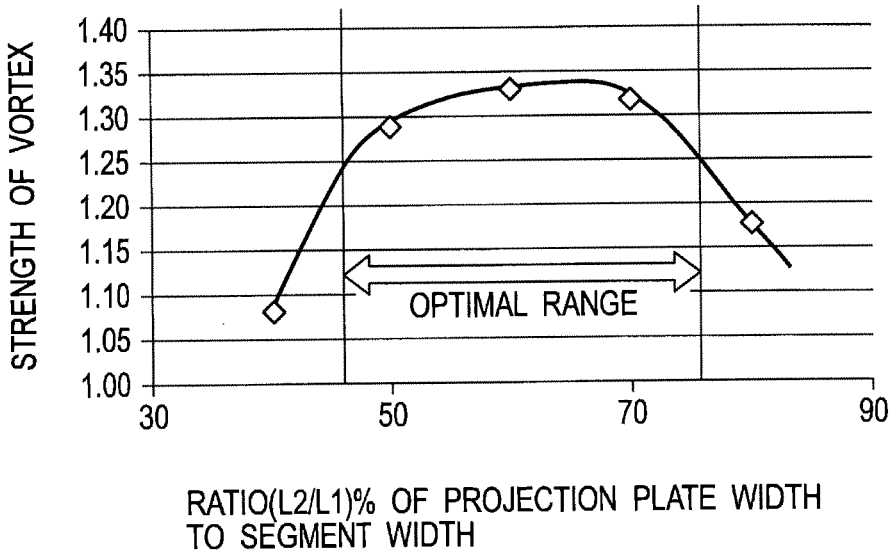
FIG. 19B is a characteristic diagram illustrating the strength of a vortex with varied width of the projection plate according to specification 4 of the embodiment of the present invention.

As illustrated in FIG. 19A and FIG. 19B, it can be seen that the width L2 of the first projection plate 25A and the second projection plate 25B is 40% to 80% of the width L1 of the segment 22 (exhaust path 20A), and the strength of vortex flow is thereby stronger ("1.1" or higher) than in Example 1 described above (that is, the strength of vortex is "1.00").

In particular, it is preferable that the width L2 of the first projection plate 25A and the second projection plate 25B be 46% to 74% of the width L1 of the segment 22. Thus, it can be seen that the strength of vortex is greater than or equal to "1.25" in contrast to Example 1 described above (that is, the strength of vortex is "1.00").

(Specification 5)

Figure 20A:
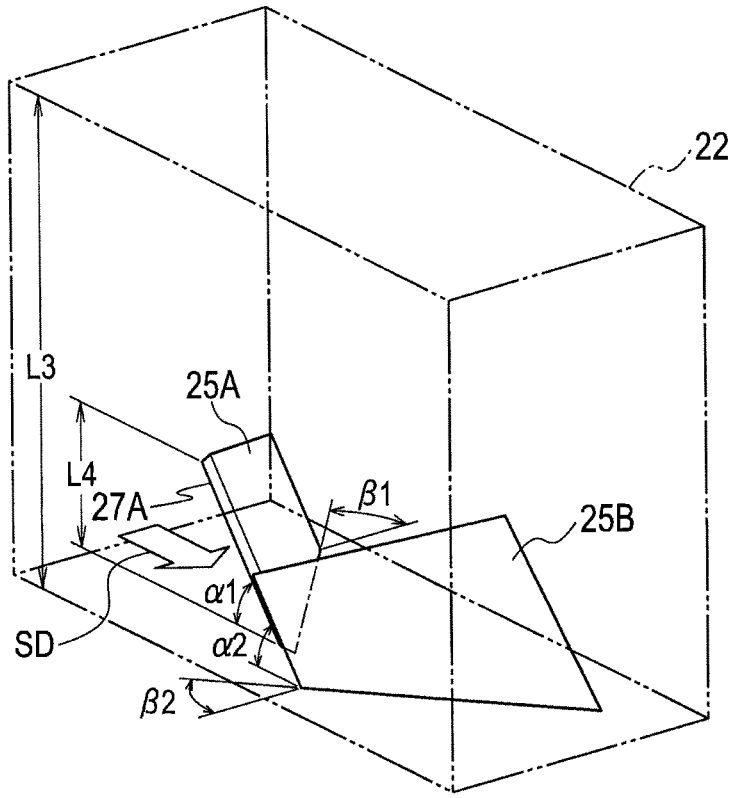
FIG. 20A is a perspective view illustrating a projection plate according to specification 5 of the embodiment of the present invention.

Next, specification 5 of the projection plate 25 will be described with reference to FIGS. 20A, 20B. FIG. 20A is a perspective view illustrating the projection plate 25, and FIG. 20B is a characteristic diagram illustrating the strength of vortex with varied height L4 of the first projection plate 25A and the second projection plate 25B for height L3 of the segment 22 (same as H15 of the above-described specification 3).

The specification 5 is such that the height L4 of the first projection plate 25A and the second projection plate 25B along the perpendicular direction CD to the exhaust gas flow direction SD is varied. It is to be noted that other conditions of the first projection plate 25A and the second projection plate 25B are the same as in the specification 3 described above.

Figure 20B:
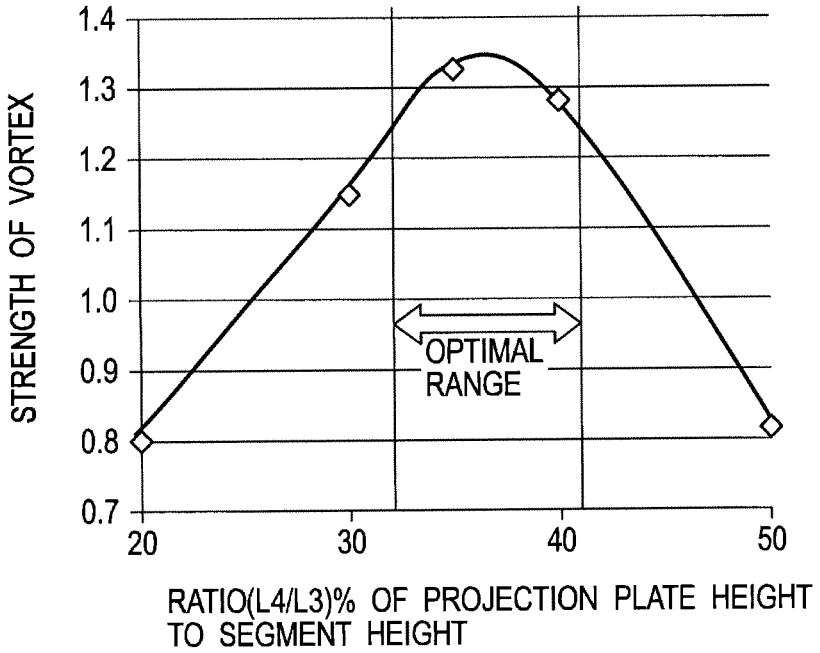
FIG. 20B is a characteristic diagram illustrating the strength of a vortex with varied height of the projection plate according to specification 5 of the embodiment of the present invention.

As illustrated in FIG. 20A and FIG. 20B, it can be seen that the height L4 of the first projection plate 25A and the second projection plate 25B is 25% to 45% of the height L3 of the segment 22 (exhaust path 20A), and the strength of vortex flow is thereby greater than in Example 1 described above (that is, the strength of vortex is "1.00").

In particular, it is preferable that the height L4 of the first projection plate 25A and the second projection plate 25B be 32% to 42% of the height L3 of the segment 22 (exhaust path 20A). Thus, it can be seen that the strength of vortex is greater than or equal to "1.25" in contrast to Example 1 described above (that is, the strength of vortex is "1.00").

(Specification 6)

Figure 21A:
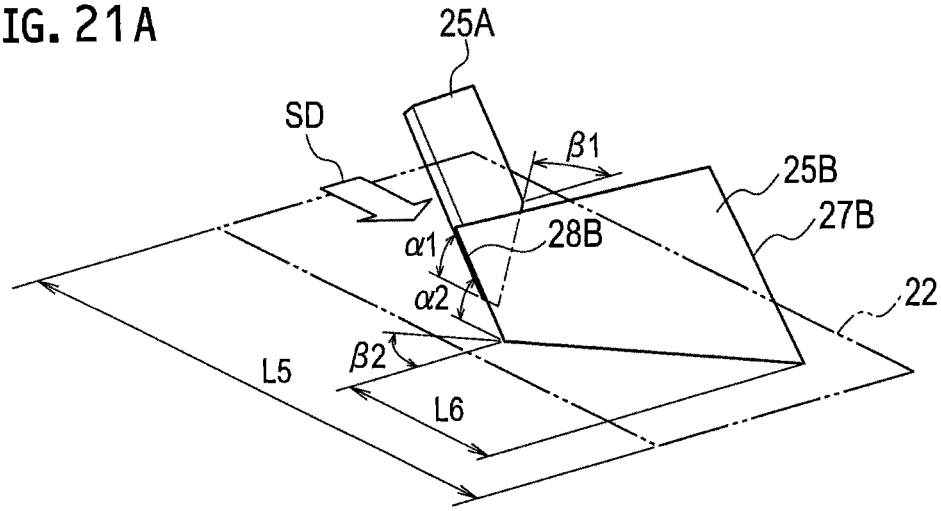
FIG. 21A is a perspective view illustrating a projection plate according to specification 6 of the embodiment of the present invention.

Next, specification 6 of the projection plate 25 will be described with reference to FIGS. 21A, 21B. FIG. 21A is a perspective view illustrating the projection plate 25, and FIG. 21B is a characteristic diagram illustrating the strength of vortex with varied length L6 of the first projection plate 25A and the second projection plate 25B for length L5 of the segment.

The specification 6 is such that the length L6 of the one lateral sides 27A, 28B of the first projection plate 25A and the second projection plate 25B along the exhaust gas flow direction SD is varied. It is to be noted that other conditions of the first projection plate 25A and the second projection plate 25B are the same as in the specification 3 described above.

Figure 21B:
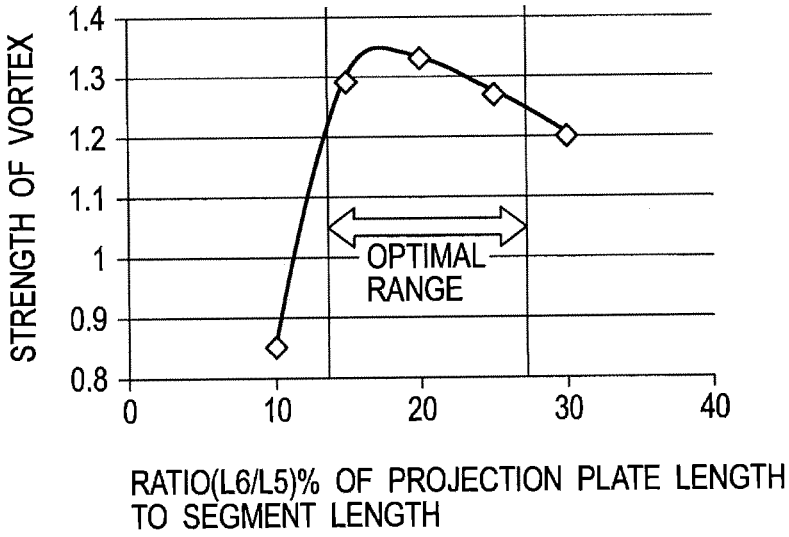
FIG. 21B is a characteristic diagram illustrating the strength of a vortex with varied length of the projection plate according to specification 6 of the embodiment of the present invention.

As illustrated in FIG. 21A, FIG. 21B, it can be seen that the length L6 of the first projection plate 25A and the second projection plate 25B is 11% to 30% of the length L5 of the segment 22 (exhaust path 20A) along the exhaust gas flow direction SD, and the strength of vortex flow is thereby greater than in Example 1 described above (that is, the strength of vortex is "1.00").

In particular, it is preferable that the length L6 of the first projection plate 25A and the second projection plate 25B be 13% to 26% of the length L5 of the segment 22 (exhaust path 20A). Thus, it can be seen that the strength of vortex is greater than or equal to "1.25" in contrast to Example 1 described above (that is, the strength of vortex is "1.00").

(Specification 7)

Figure 22A:
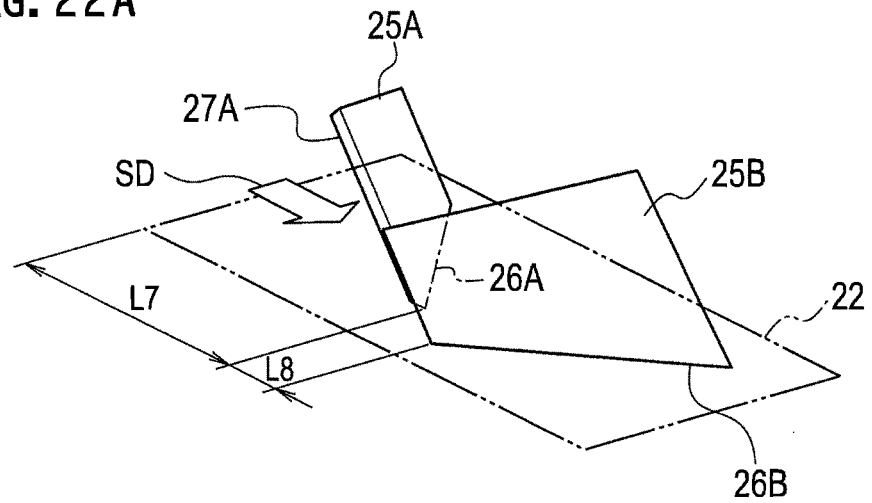
FIG. 22A is a perspective view illustrating a projection plate according to specification 7 of the embodiment of the present invention.

Next, specification 7 of the projection plate 25 will be described with reference to FIGS. 22A, 22B. FIG. 22A is a perspective view illustrating the projection plate 25, and FIG. 22B is a characteristic diagram illustrating the strength of vortex with varied minimum interval L8 between the first projection plate 25A and the second projection plate 25B with respect to length L7 from the upstream end of the segment 22 in the exhaust gas flow direction SD to the base side 26A side of the one lateral side 27A of the first projection plate 25A along the exhaust gas flow direction SD.

The specification 7 is such that the minimum interval L8 between the first projection plate 25A and the second projection plate 25B is varied. It is to be noted that other conditions of the first projection plate 25A and the second projection plate 25B are the same as in the specification 3 described above.

Figure 22B:
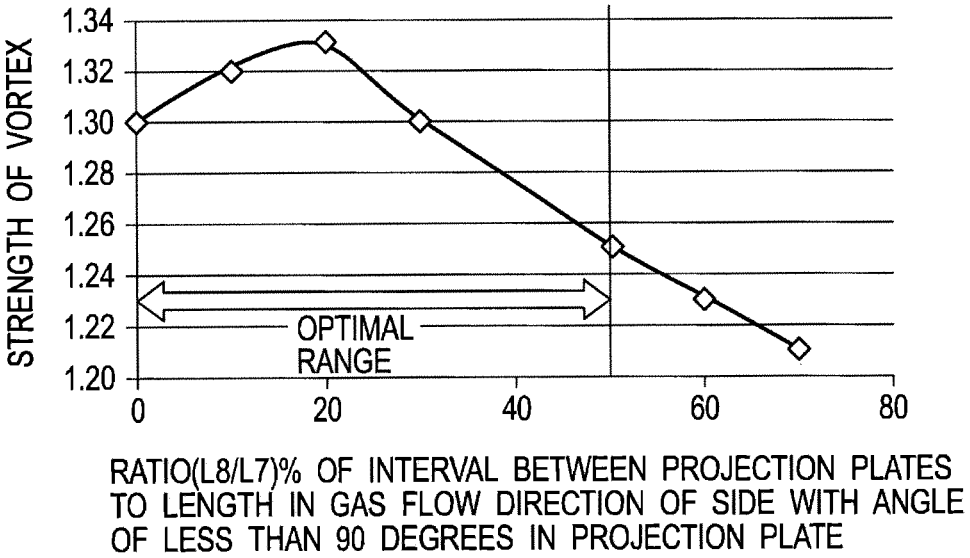
FIG. 22B is a characteristic diagram illustrating the strength of a vortex with varied minimum interval between the projection plates according to specification 7 of the embodiment of the present invention.

As illustrated in FIG. 22A and FIG. 22B, it can be seen that the minimum interval L8 between the first projection plate 25A and the second projection plate 25B is 0% to 70% of the length L7 from the upstream end of the segment 22 (exhaust path 20A) in the exhaust gas flow direction SD to the base side 26A side of the one lateral side 27A of the first projection plate 25A along the exhaust gas flow direction SD, and the strength of vortex flow is thereby stronger ("1.23" or higher) than in Example 1 described above (that is, the strength of vortex is "1.00").

In particular, it is preferable that the minimum interval L8 between the first projection plate 25A and the second projection plate 25B be 0% to 50% of the length L7 from the upstream end of the segment 22 (exhaust path 20A) in the exhaust gas flow direction SD to the base side 26A side of the one lateral side 27A of the first projection plate 25A along the exhaust gas flow direction SD. Thus, it can be seen that the strength of vortex is greater than or equal to "1.25" in contrast to Example 1 described above (that is, the strength of vortex is "1.00").

(Specification 8)

Figure 23A:
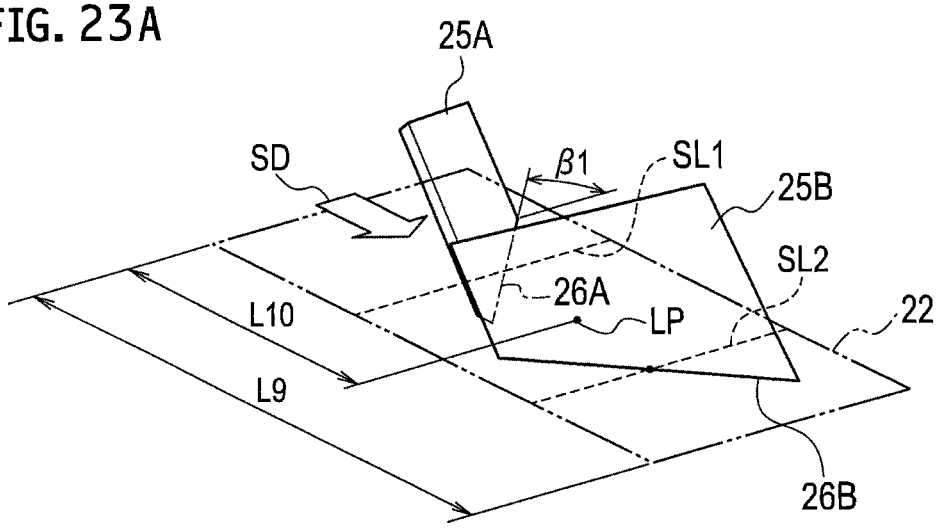
FIG. 23A is a perspective view illustrating a projection plate according to specification 8 of the embodiment of the present invention.

Next, specification 8 of the projection plate 25 will be described with reference to FIGS. 23A, 23B. FIG. 23A is a perspective view illustrating the projection plate 25, and FIG. 23B is a characteristic diagram illustrating the strength of vortex with varied length L10 from the upstream end of the segment 22 in the exhaust gas flow direction SD to lengthwise central point LP between the first projection plate 25A and the second projection plate 25B along the exhaust gas flow direction SD with respect to length L9 of the segment 22.

The specification 8 is such that the lengthwise central point LP between the first projection plate 25A and the second projection plate 25B is varied. It is to be noted that other conditions of the first projection plate 25A and the second projection plate 25B are the same as in the specification 3 described above.

Figure 23B:
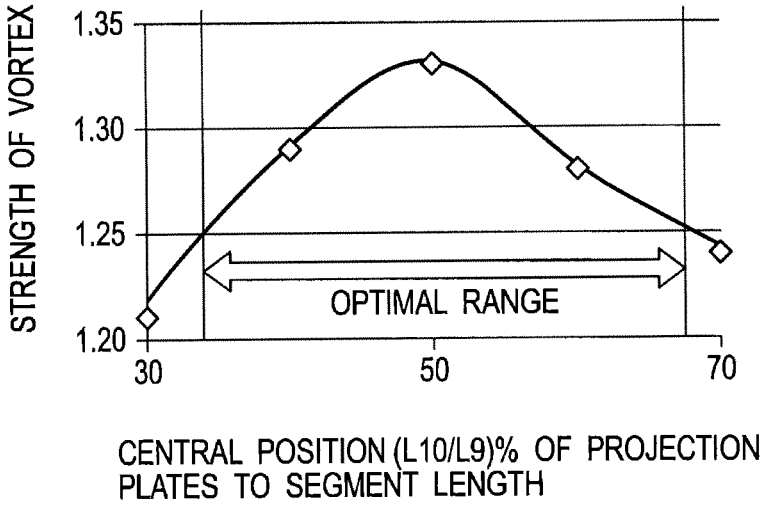
FIG. 23B is a characteristic diagram illustrating the strength of a vortex with varied lengthwise central position of the projection plate according to specification 8 of the embodiment of the present invention.

As illustrated in FIG. 23A and FIG. 23B, the lengthwise central point LP is the central position in the exhaust gas flow direction SD between an auxiliary line SL1 which passes through the central position of the base side 26A of the first projection plate 25A along the perpendicular direction CD, and an auxiliary line SL2 which passes through the central position of the base side 26B of the second projection plate 25B along the perpendicular direction CD.

It can be seen that the lengthwise central point LP between the first projection plate 25A and the second projection plate 25B is provided in a range of 30% to 70% of the length L9 of the segment 22 (exhaust path 20A) along the exhaust gas flow direction SD from the upstream side of the segment 22 (exhaust path 20A), and the strength of vortex flow is thereby stronger ("1.21" or higher) than in Example 1 described above (that is, the strength of vortex is "1.00").

In particular, it is preferable that the lengthwise central point LP between the first projection plate 25A and the second projection plate 25B be provided in a range of 35% to 67% of the length L9 of the segment 22 (exhaust path 20A) along the exhaust gas flow direction SD from the upstream side of the segment 22 (exhaust path 20A). Thus, it can be seen that the strength of vortex is greater than or equal to "1.25" in contrast to Example 1 described above (that is, the strength of vortex is "1.00").

(Specification 9)

Figure 24A:
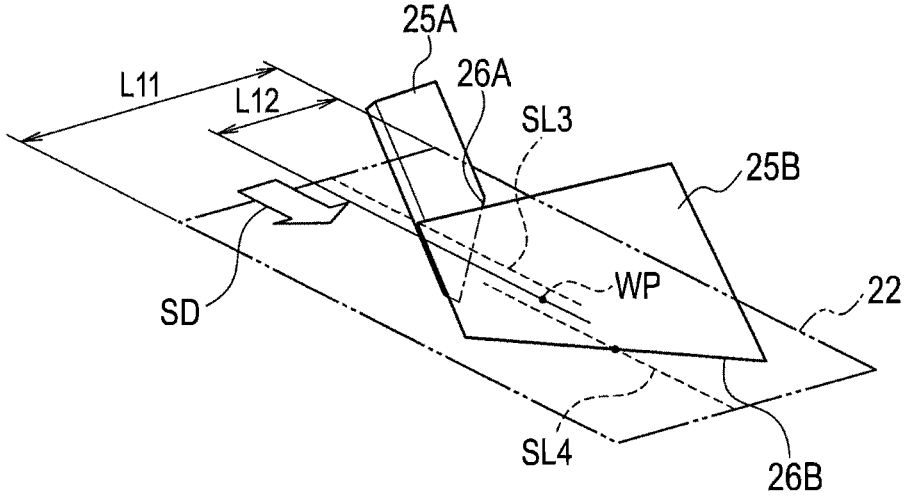
FIG. 24A is a perspective view illustrating a projection plate according to specification 9 of the embodiment of the present invention.

Next, specification 9 of the projection plate 25 will be described with reference to FIGS. 24A, 24B. FIG. 24A is a perspective view illustrating the projection plate 25, and FIG. 24B is a characteristic diagram illustrating the strength of vortex with varied length L12 from one end of the segment 22 in the perpendicular direction CD to widthwise central point WP between the first projection plate 25A and the second projection plate 25B in the perpendicular direction CD with respect to width L11 of the segment 22.

The specification 9 is such that widthwise central point WP between the first projection plate 25A and the second projection plate 25B is varied. It is to be noted that other conditions of the first projection plate 25A and the second projection plate 25B are the same as in the specification 3 described above.

Figure 24B:
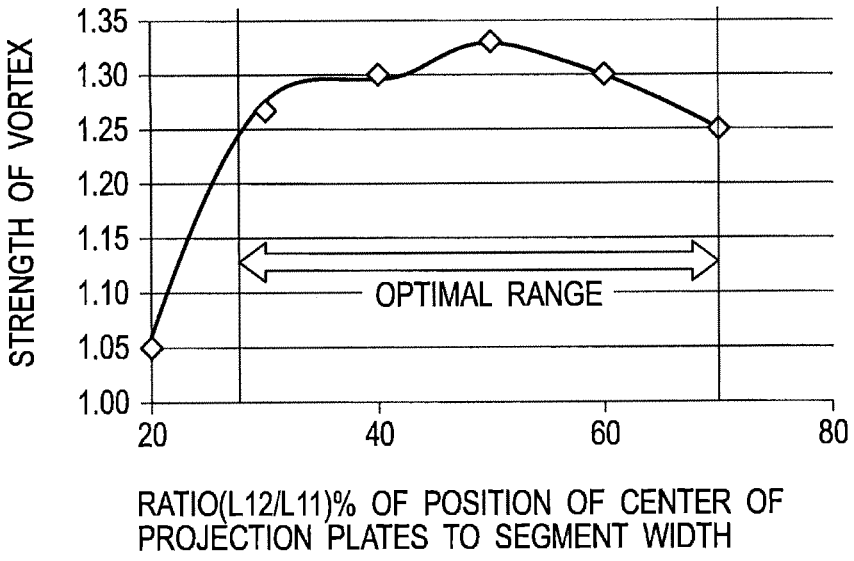
FIG. 24B is a characteristic diagram illustrating the strength of a vortex with varied widthwise central position of the projection plate according to specification 9 of the embodiment of the present invention.

As illustrated in FIG. 24A and FIG. 24B, the widthwise central point WP is the central position in the perpendicular direction CD between an auxiliary line SL3 which passes through the central position of the base side 26A of the first projection plate 25A along the exhaust gas flow direction SD, and an auxiliary line SL4 which passes through the central position of the base side 26B of the second projection plate 25B along the exhaust gas flow direction SD.

In particular, it is preferable that the widthwise central point WP between the first projection plate 25A and the second projection plate 25B be provided at the widthwise center as a reference in a range of 20% to 70% of the width L11 of the segment 22 (exhaust path 20A) along the perpendicular direction CD to the exhaust gas flow direction SD. Thus, it can be seen that the strength of vortex is superior ("1.05" or higher) to that in Example 1 described above (that is, the strength of vortex is "1.00").

In particular, it is preferable that the widthwise central point WP between the first projection plate 25A and the second projection plate 25B be provided at the widthwise center as a reference in a range of 26% to 70% of the width L11 of the segment 22 (exhaust path 20A). Thus, it can be seen that the strength of vortex is greater than or equal to "1.25" in contrast to Example 1 described above (that is, the strength of vortex is "1.00").

(Specification 10)

Figure 25A:
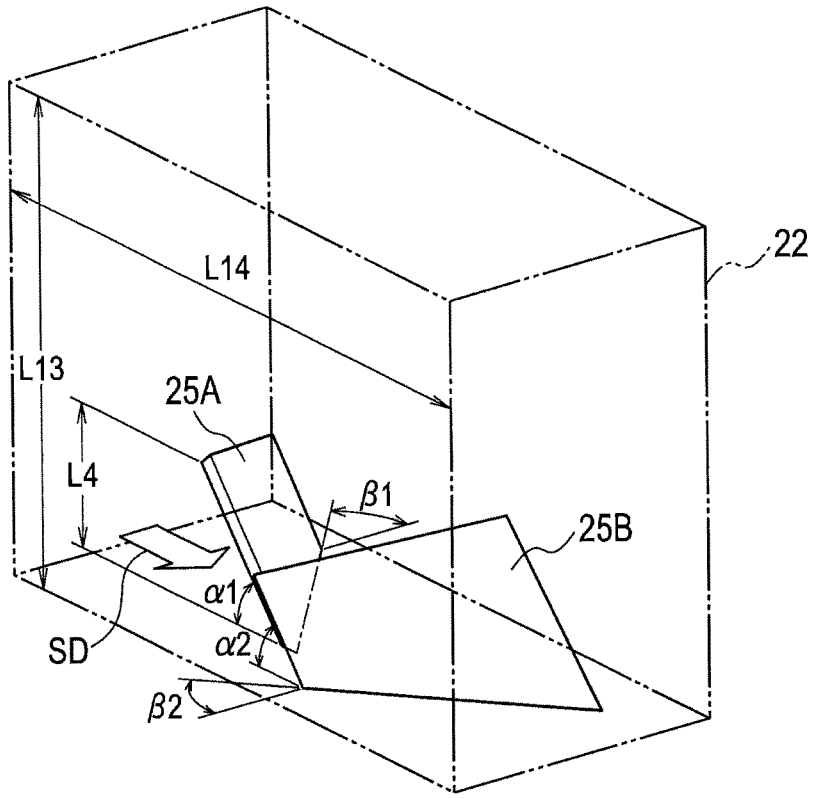
FIG. 25A is a perspective view illustrating a projection plate and a segment according to specification 10 of the embodiment of the present invention.

Next, specification 10 of the segment 22 will be described with reference to FIGS. 25A, 25B. FIG. 25A is a perspective view illustrating the projection plate 25 and the segment 22, and FIG. 25B is a characteristic diagram illustrating the strength of vortex with varied segment 22.

The specification 10 is such that height L13 of the segment 22 in the tube stacking direction PD and length L14 of the segment 22 in the exhaust gas flow direction SD are varied. It is to be noted that the conditions of the first projection plate 25 except for the configuration of the segment 22 are the same as in the specification 3 described above.

Figure 25B:
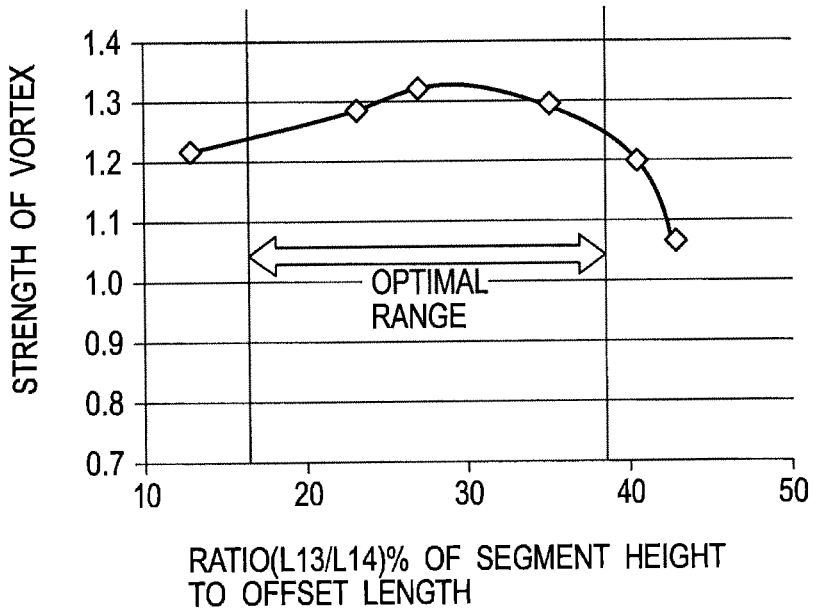
FIG. 25B is a characteristic diagram illustrating the strength of a vortex with varied segment according to specification 10 of the embodiment of the present invention.

As illustrated in FIG. 25A and FIG. 25B, it is preferable that the height L13 of the segment 22 be 16% to 38% of the length L14 of the segment 22 in the exhaust gas flow direction SD. Thus, it can be seen that the strength of vortex is greater than or equal to "1.25" in contrast to Example 1 described above (that is, the strength of vortex is "1.00").

(Specification 11)

Figure 26A:
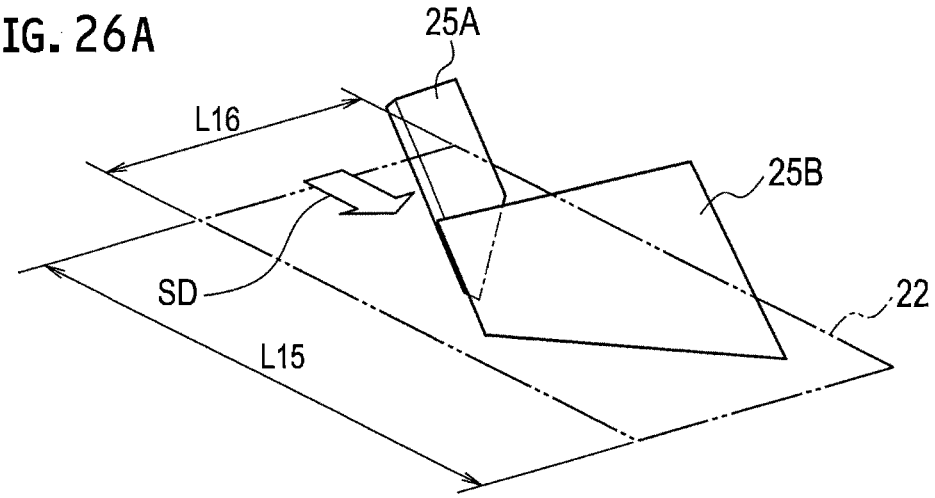
FIG. 26A is a perspective view illustrating part of a projection plate and a segment according to specification 11 of the embodiment of the present invention.

Next, specification 11 of the segment 22 will be described with reference to FIGS. 26A, 26B. FIG. 26A is a perspective view illustrating part of the projection plate 25 and of the segment 22, and FIG. 26B is a characteristic diagram illustrating the strength of vortex with varied segment 22.

The specification 11 is such that length L15 of the segment 22 in the exhaust gas flow direction SD and width L16 of the segment 22 along the perpendicular direction CD to the exhaust gas flow direction SD are varied. It is to be noted that the conditions of the first projection plate 25 except for the configuration of the segment 22 are the same as in the specification 3 described above.

Figure 26B:
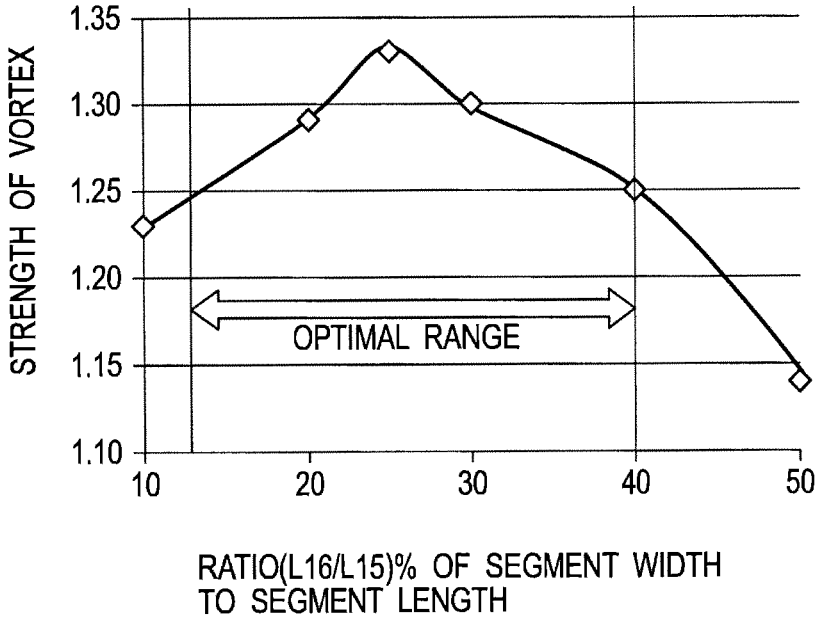
FIG. 26B is a characteristic diagram illustrating the strength of a vortex with varied segment according to specification 11 of the embodiment of the present invention.

As illustrated in FIG. 26A and FIG. 26B, it is preferable that the width L16 of the segment 22 be 12% to 40% of the length L15 of the segment 22. Thus, it can be seen that the strength of vortex is greater than or equal to "1.25" in contrast to Example 1 described above (that is, the strength of vortex is "1.00").

(Specification 12)

Figure 27A:
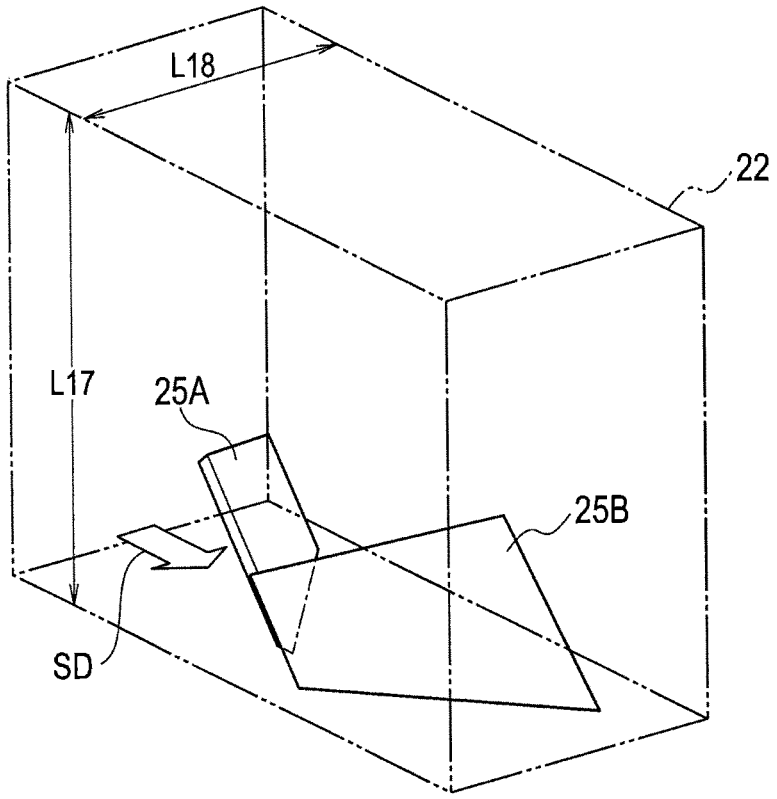
FIG. 27A is a perspective view illustrating a projection plate and a segment according to specification 12 of the embodiment of the present invention.

Next, specification 12 of the segment 22 will be described with reference to FIGS. 27A, 27B. FIG. 27A is a perspective view illustrating the projection plate 25 and the segment 22, and FIG. 27B is a characteristic diagram illustrating the strength of vortex with varied segment 22.

The specification 12 is such that height L17 of the segment 22 in the tube stacking direction PD and width L18 of the segment 22 along the perpendicular direction CD to the exhaust gas flow direction SD are varied. It is to be noted that the conditions of the first projection plate 25 except for the configuration of the segment 22 are the same as in the specification 3 described above.

Figure 27B:
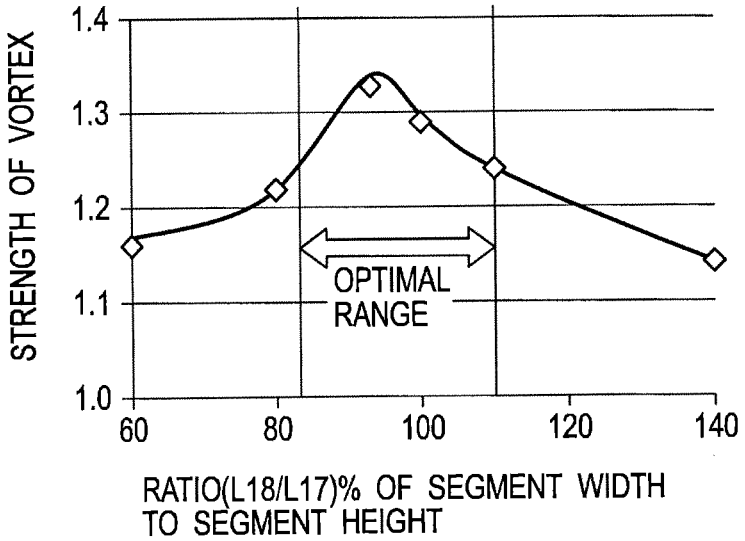
FIG. 27B is a characteristic diagram illustrating the strength of a vortex with varied segment according to specification 12 of the embodiment of the present invention.

As illustrated in FIG. 27A and FIG. 27B, it is preferable that the width L18 of the segment 22 be 85% to 110% of the height L17 of the segment 22. Thus, it can be seen that the strength of vortex is greater than or equal to "1.25" in contrast to Example 1 described above (that is, the strength of vortex is "1.00").

(Specification 13)

Figure 28A:
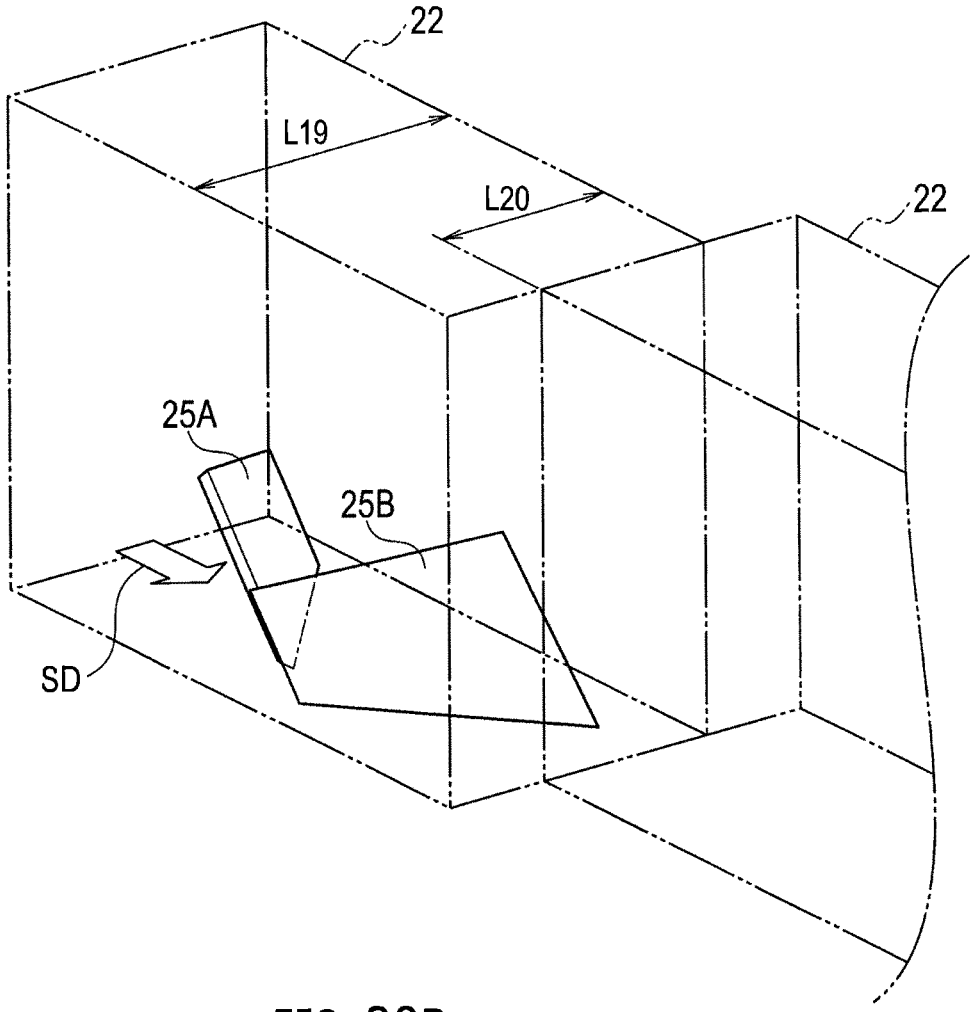
FIG. 28A is a perspective view illustrating a projection plate and a segment according to specification 13 of the embodiment of the present invention.

Next, specification 13 of the segment 22 will be described with reference to FIGS. 28A, 28B. FIG. 28A is a perspective view illustrating the projection plate 25 and the segment 22, and FIG. 28B is a characteristic diagram illustrating the strength of vortex with varied displacement amount between adjacent segments 22 in the exhaust gas flow direction SD in the segments 22.

The specification 13 is such that the displacement amount of a segment 22 with respect to the adjacent segment 22 in the exhaust gas flow direction SD is varied. It is to be noted that the conditions of the first projection plate 25 except for the configuration of the segment 22 are the same as in the specification 3 described above.

Figure 28B:
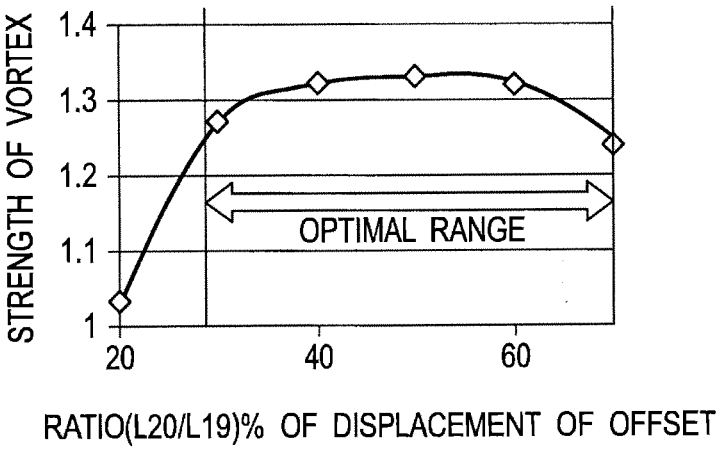
FIG. 28B is a characteristic diagram illustrating the strength of a vortex of the segment with varied displacement amount between adjacent segments in an exhaust gas direction according to specification 13 of the embodiment of the present invention.

As illustrated in FIG. 28A and FIG. 28B, the amount of displacement of each segment 22 is preferably such that length L20 from one end, in the perpendicular direction CD, of the segment 22 located on the upstream side to the other end, in the perpendicular direction CD, of the segment 22 located on the downstream side be displaced by 28% to 69% with respect to width L19 of the segment 22 located on the upstream side between adjacent segments 22 in the exhaust gas flow direction SD. Thus, it can be seen that the strength of vortex is greater than or equal to "1.25" in contrast to Example 1 described above (that is, the strength of vortex is "1.00").

Other Embodiments

As described above, the content of the present invention has been disclosed through the Example of the present invention. However, it should not be understood that the discussion and the drawings that constitute part of the disclosure limit the present invention. Various alternative embodiments, examples, and operational techniques will be apparent to those skilled in the art from the disclosure.

For instance, the embodiment of the present invention may be modified as follows. Specifically, the heat exchanger 1 has been described as an EGR cooler. However, the invention is not limited to this, and the heat exchanger 1 may be a heat exchanger that exchanges heat between gas and liquid (for instance, water-cooled air supply cooler (water-cooled CAC cooler) or an exhaust heat collector) or a heat exchanger that exchanges heat between gases (for instance, an air-cooled air supply cooler (air-cooled CAC cooler)).

Also, it has been described that the projection plate 25 is formed in the horizontal wall 23 of the segment 22. However, the invention is not limited to this, and the projection plate 25 may be formed in the vertical wall 24 of the segment 22.

Also, it has been described that the first projection plate 25A and the second projection plate 25B are a trapezoid. However, the invention is not limited to this, and the first projection plate 25A and the second projection plate 25B may be a polygon with four or more sides having the base side in contact with the peripheral surface of the exhaust path 20A and a pair of right and left lateral sides.

Also, it has been described that the top sides 29A, 29B of the first projection plate 25A and the second projection plate 25B are inclined with respect to the base sides 26A, 26B. However, the invention is not limited to this, and the top sides 29A, 29B may be provided in parallel with the base sides 26A, 26B.

Also, it has been described that the angles a, a' of the one lateral sides 27A, 27B of the first projection plate 25A and the second projection plate 25B with respect to the base sides 26A, 26B are set to be smaller than 90 degrees, and the angles b, b' of the other lateral sides 28A, 28B with respect to the base sides 26A, 26B are set to be 90 degrees or more. However, the invention is not limited to this, and each angle may be set to any degrees as long as the angles a, a' are smaller than the angles b, b'.

Also, it has been described that the first projection plate 25A and the second projection plate 25B are arranged in the same orientation in adjacent segments 22 in the perpendicular direction CD. However, the invention is not limited to this, and the first projection plate 25A and the second projection plate 25B may be arranged line-symmetrically in the adjacent segments 22 in the perpendicular direction CD.

Also, it has been described that the first projection plate 25A and the second projection plate 25B are arranged line-symmetrically with respect to the perpendicular direction CD in adjacent segments 22 in the exhaust gas flow direction SD. However, the invention is not limited to this, and the first projection plate 25A and the second projection plate 25B may be arranged in the same orientation in the adjacent segments 22 in the exhaust gas flow direction SD.

As described above, the present invention includes various embodiments which are not described herein as a matter of course. Accordingly, the technical scope of the present invention is determined only by the matters to define the invention in the scope of claims regarded as appropriate from the aforementioned description.

The entire content of Japanese Patent Application No. 2013-108789 (filed May 23, 2013) is incorporated herein by reference.

The invention claimed is:

1. A heat exchanger, comprising:

a gas path for flowing gas;

a first plurality of segments arranged in the gas path and arranged to respectively form projections and depressions repeated in a perpendicular direction to a gas flow direction;

a second plurality of segments arranged in the gas path, arranged to respectively form projections and depressions repeated in the perpendicular direction to the gas flow direction, and located downstream of the first plurality of segments in the gas flow direction;

a first projection plate arranged in the gas path and projecting from each segment of the first and second plurality of segments; and a second projection plate arranged in the gas path, projecting from each segment of the first and second plurality of segments, and located downstream of the first projection plate in the gas flow direction in each segment, wherein an arrangement of the first plurality of segments and the second plurality of segments allows the gas to flow from two segments of the first plurality of segments adjacent in the perpendicular direction to the gas flow direction to a segment of the second plurality of segments, the first projection plate and the second projection plate of each segment of the first plurality of segments cause the gas flowing into each segment to flow out from each segment while causing rotation in the gas in different directions with respect to a rotational axis in the gas flow direction and then flow into each of two segments of the second plurality of segments adjacent in the perpendicular direction to the gas flow direction, and a width of each of the first projection plate and the second projection plate in the perpendicular direction to the gas flow direction is 46% to 74% of a width of each segment in the perpendicular direction to the gas flow direction.

2. The heat exchanger according to claim 1, wherein the first projection plates and the second projection plates are structured as a polygon with four or more sides.

3. The heat exchanger according to claim 1, wherein, in each segment, the first projection plate and the second projection plate are arranged at a forward tilt angle in a forward inclined state to an upstream side in the gas flow direction.

4. The heat exchanger according to claim 1, wherein a first base side of each first projection plate in contact with each segment is arranged obliquely at a first setting angle with respect to the perpendicular direction to the gas flow direction, and a second base side of each of the second projection plate in contact with each segment is arranged at a second setting angle line-symmetrical to the first setting angle with respect to the perpendicular direction to the gas flow direction.

5. The heat exchanger according to claim 1, wherein out of a pair of first lateral sides standing from both ends of a first base side of each first projection plate in contact with each segment, one first lateral side of the pair of first lateral sides located downstream of another first lateral side of the pair of first lateral sides in the gas flow direction is longer than the other first lateral side, and out of a pair of second lateral sides standing from both ends of a second base side of each second projection plate in contact with each segment, one second lateral side of the pair of second lateral sides located downstream of another second lateral side of the pair of second lateral sides in the gas flow direction is longer than the other second lateral side.

6. The heat exchanger according to claim 1, wherein a first top side farthest away from a first base side of each first projection plate in contact with each segment is inclined with respect to the first base side such that one first lateral side of a pair of first lateral sides standing from both ends of the first base side and located downstream of another first lateral side of the pair of first lateral sides in the gas flow direction is lower than the other first lateral side in a front view in the gas flow direction, and a second top side farthest away from a second base side of each second projection plate in contact with each segment is inclined with respect to the second base side such that one second lateral side of a pair of second lateral sides standing from both ends of the second base side and located downstream of the other another second lateral side of the pair of second lateral sides in the gas flow direction is lower than the other second lateral side in the front view in the gas flow direction.

7. The heat exchanger according to claim 5, wherein an angle of the one first lateral side of each first projection plate with respect to the first base side is smaller than 90 degrees, and an angle of the one second lateral side of each second projection plate with respect to the second base side is smaller than 90 degrees.

8. The heat exchanger according to claim 5, wherein an angle of the other first lateral side of each first projection plate with respect to the first base side is larger than or equal to 90 degrees, and an angle of the other second lateral side of each second projection plate with respect to the second base side is larger than or equal to 90 degrees.

9. The heat exchanger according to claim 3, wherein the forward tilt angle is 40 to 50 degrees with respect to the gas flow direction.

10. The heat exchanger according to claim 4, wherein the first and second setting angles are 33 to 65 degrees with respect to the perpendicular direction to the gas flow direction.

11. The heat exchanger according to claim 1, wherein the first projection plates of the segments adjacent in the perpendicular direction to the gas flow direction project symmetrically to each other, the second projection plates of the segments adjacent in the perpendicular direction to the gas flow direction project symmetrically to each other, setting angles at which base sides of the first projection plates of the segments adjacent in the perpendicular direction to the gas flow direction in contact with the segments are arranged obliquely with respect to the perpendicular direction to the gas flow direction are the same, and setting angles at which base sides of the second projection plates of the segments adjacent in the perpendicular direction to the gas flow direction in contact with the segments are arranged obliquely with respect to the perpendicular direction to the gas flow direction are the same.

12. The heat exchanger according to claim 1, wherein setting angles at which base sides of the first projection plates of the segments adjacent in the gas flow direction in contact with the segments are arranged obliquely with respect to the perpendicular direction to the gas flow direction are line-symmetric with respect to the perpendicular direction to the gas flow direction, and setting angles at which base sides of the second projection plates of the segments adjacent in the gas flow direction in contact with the segments are arranged obliquely with respect to the perpendicular direction to the gas flow direction are line-symmetric with respect to the perpendicular direction to the gas flow direction.

* * * * *